US007388561B2

(12) United States Patent
Yamano et al.

(10) Patent No.: US 7,388,561 B2
(45) Date of Patent: Jun. 17, 2008

(54) CHARACTERISTICS ADJUSTMENT METHOD OF IMAGE FORMING APPARATUS, MANUFACTURING METHOD OF IMAGE FORMING APPARATUS AND CHARACTERISTICS ADJUSTMENT APPARATUS OF IMAGE FORMING APPARATUS

(75) Inventors: Akihiko Yamano, Kanagawa (JP); Mitsutoshi Kuno, Kanagawa (JP); Shuji Aoki, Kanagawa (JP); Takahiro Oguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 520 days.

(21) Appl. No.: 11/049,996

(22) Filed: Feb. 4, 2005

(65) Prior Publication Data

US 2005/0148272 A1 Jul. 7, 2005

Related U.S. Application Data

(62) Division of application No. 10/252,038, filed on Sep. 23, 2002, now Pat. No. 6,888,519.

(30) Foreign Application Priority Data

Sep. 28, 2001 (JP) ..... 2001-304610

(51) Int. Cl.
*G09G 3/22* (2006.01)

(52) U.S. Cl. ..... 345/75.2; 345/74.1; 345/207; 315/167

(58) Field of Classification Search ..... 345/55, 345/74.1, 75.1, 75.2, 104, 207; 315/167, 315/169.1, 169.2, 169.3
See application file for complete search history.

(56) References Cited

U.S. PATENT DOCUMENTS

| | | | | |
|---|---|---|---|---|
| 5,581,159 | A | 12/1996 | Lee et al. | 315/167 |
| 5,656,892 | A | 8/1997 | Zimlich et al. | 315/169.3 |
| 5,659,328 | A * | 8/1997 | Todokoro et al. | 345/74.1 |
| 5,734,361 | A * | 3/1998 | Suzuki et al. | 345/74.1 |
| 5,834,900 | A * | 11/1998 | Tanaka et al. | 315/169.1 |
| 6,031,344 | A | 2/2000 | Foo et al. | 315/307 |
| 6,231,412 | B1 | 5/2001 | Kawade et al. | 445/3 |
| 6,445,367 | B1 | 9/2002 | Suzuki et al. | 345/75.2 |

(Continued)

FOREIGN PATENT DOCUMENTS

EP 0 755 042 A1 1/1997

(Continued)

*Primary Examiner*—Richard Hjerpe
*Assistant Examiner*—My-Chau T Tran
(74) *Attorney, Agent, or Firm*—Fitzpatrick, Cella, Harper & Scinto

(57) ABSTRACT

There is provided a characteristic adjustment method for an image forming apparatus that is provided with a multi-electron source in which a plurality of electron-emitting devices are electrically connected by wiring and arranged on a substrate and a fluorescent member for emitting light by irradiation of an electron beam, the method including: a measurement step of dividing a display portion of the image forming apparatus into a plurality of areas and measuring light emitting characteristics of at least one or more of the electron-emitting devices in the respective divided areas, and a shifting step of shifting the light emitting characteristics of the electron-emitting devices in the divided areas to individual characteristic target values by applying a characteristic shift voltage to the electron-emitting devices.

3 Claims, 18 Drawing Sheets

U.S. PATENT DOCUMENTS

| | | | | |
|---|---|---|---|---|
| 6,465,966 | B2 | 10/2002 | Konuma | 315/169.1 |
| 6,528,951 | B2 | 3/2003 | Yamazaki et al. | 315/169.3 |
| 6,534,924 | B1 | 3/2003 | Oguchi et al. | 315/169.1 |
| 6,552,702 | B1 | 4/2003 | Abe et al. | 345/98 |
| 6,580,407 | B1 * | 6/2003 | Suzuki et al. | 345/74.1 |
| 6,604,972 | B1 | 8/2003 | Yamano | 445/24 |
| 6,621,475 | B1 * | 9/2003 | Yamaguchi et al. | 345/74.1 |
| 6,661,179 | B2 | 12/2003 | Aoki et al. | 315/169.1 |
| 6,677,706 | B1 | 1/2004 | Hara et al. | 313/496 |
| 6,707,437 | B1 * | 3/2004 | Kuno et al. | 345/74.1 |
| 6,712,660 | B2 | 3/2004 | Aoki et al. | 445/3 |
| 6,760,001 | B2 | 7/2004 | Kanda et al. | 345/74.1 |
| 6,822,397 | B2 * | 11/2004 | Kawasaki et al. | 315/169.2 |
| 2002/0008482 | A1 | 1/2002 | Konuma | 315/169.3 |
| 2004/0174323 | A1 * | 9/2004 | Yamashita et al. | 345/75.2 |

FOREIGN PATENT DOCUMENTS

| | | |
|---|---|---|
| EP | 0 803 892 A2 | 10/1997 |
| JP | 10-228867 | 8/1998 |
| JP | 11-133911 | 5/1999 |
| JP | 2001-209352 | 8/2001 |

* cited by examiner

CHARACTERISTICS ADJUSTMENT METHOD OF IMAGE FORMING APPARATUS, MANUFACTURING METHOD OF IMAGE FORMING APPARATUS AND CHARACTERISTICS ADJUSTMENT APPARATUS OF IMAGE FORMING APPARATUS

This application is a division of U.S. application Ser. No. 10/252,038, filed Sep. 23, 2002 now U.S. Pat. No. 6,888, 519.

BACKGROUND OF THE INVENTION

1. Field of the Invention

The present invention relates to an image forming apparatus provided with a large number of surface conduction electron emission devices and to a characteristics adjustment method for an image forming apparatus, a manufacturing method for an image forming apparatus and a characteristics adjustment apparatus that are preferably applied to such an image forming apparatus.

2. Related Background Art

Up to now, there have been known two types of electron-emitting devices, namely, a hot cathode device and a cold cathode device. As the cold cathode device, for example, a field emission device, a metal/insulator/metal electron-emitting device and a surface conduction electron emission device are known.

Among the electron-emitting devices known as the cold cathode device, the surface conduction electron emission device (hereinafter also referred to simply as device) utilizes a phenomenon that electron emission is generated by flowing an electric current to a thin film of $SnO_2$, Au, $In_2O_3$/$SnO_2$, carbon or the like of a small area, which is formed on a substrate, in parallel with the surface of the film.

The conventional surface conduction electron emission device will be described with reference to FIG. 17. FIG. 17 illustrates a structure of the conventional surface conduction electron emission device. In the figure, reference numeral 3001 denotes a substrate and 3004 denotes an electroconductive thin film consisting of metal oxide formed by spattering. The electroconductive thin film 3004 is formed in a flat H-shape as illustrated.

An electron-emitting region 3005 is formed by applying an energization operation called energization forming to the electroconductive thin film 3004. An interval L and an interval W in the figure are set to be 0.5 to 1 (mm) and 0.1 (mm), respectively.

Note that, although the electron-emitting region 3005 is shown in the center of the electroconductive thin film 3004 in a rectangular shape for convenience of illustration, this is only schematic and does not represent an actual position or shape of an electron-emitting region faithfully.

As already described, in forming an electron-emitting region of a surface conduction electron emission device, an operation for flowing an electric current to an electroconductive thin film to destroy or deform or deteriorate the thin film locally and form a crack (energization forming operation) is performed.

It is possible to improve an electron-emitting characteristic significantly by further performing an energization activation operation thereafter.

That is, this energization activation operation means an operation for energizing an electron-emitting region, which is formed by the energization forming operation, under appropriate conditions to cause carbon or carbon compound to deposit in its vicinity.

For example, a pulse of a predetermined voltage is periodically applied in a vacuum atmosphere in which organic matter of an appropriate partial pressure exists and a total pressure is $10^{-2}$ to $10^{-3}$ (Pa), whereby any one of monocrystal graphite, polycrystal graphite and amorphous carbon or mixture of them-is deposited in the vicinity of an electron-emitting region to have a thickness of approximately 500 (angstroms) or less.

Note that it is needless to mention that this condition is merely an example and should be appropriately changed according to a material or a shape of a surface conduction electron emission device.

By performing such an operation, an emission current under the same applied voltage can be typically increased to approximately 100 times or more as large as that immediately after energization forming.

Therefore, in manufacturing a multi-electron source that utilizes the above-mentioned large number of surface conduction electron emission devices, it is also desirable to apply the energization activation operation to each device. (Note that it is desirable to reduce the partial pressure of organic matter in the vacuum atmosphere after finishing the energization activation. This is called a stabilization process.)

FIG. 18 is a typical graph of an emission current Ie to device applied voltage Vf characteristic and a device current If to device applied voltage Vf characteristic of a surface conduction electron emission device. Here, in this specification, an emission current means a current that flows between an electron-emitting device and an anode because an electron, which is emitted into a space when the electron-emitting device is driven, is attracted to and collides against the anode if an acceleration voltage is applied to the anode.

Further, the emission current Ie is extremely small compared with the device current If and it is difficult to illustrate them in an identical scale. In addition, these characteristics change when design parameters such as a size and a shape of a device is changed. Thus, two graphs are shown by arbitrary units, respectively.

A surface conduction electron emission device has three characteristics with respect to the emission current Ie as described below.

When a voltage equal to or higher than a certain voltage (which is called threshold voltage Vth) is applied to the device, the emission current Ie increases steeply. On the other hand, the emission current Ie is hardly detected under a voltage lower than the threshold voltage Vth.

That is, the device is a nonlinear device having the clear threshold voltage Vth with respect to the emission current Ie.

Since the emission current Ie changes depending on the voltage Vf applied to the device, a magnitude of the emission current Ie can be controlled by the voltage Vf.

Since a response speed of the current Ie emitted from the device to the voltage Vf applied to the device is high, an amount of charges of electrons emitted from the device can be controlled according to a length of time during which the voltage Vf is applied.

For characteristic adjustment of the surface conduction electron emission device, as described in Japanese Patent Application Laid-Open No. 10-228867 and the like, characteristics of each device can be adjusted by applying a voltage equal to or higher than a certain voltage (which is called threshold voltage-Vth) to the device, that is, by applying a characteristic shift voltage (hereinafter also referred to simply as shift voltage) for adjusting characteristics.

Incidentally, a surface conduction electron emission device has an advantage in that a large number of devices can be formed over a large area because it has a simple structure and is easily manufactured.

Thus, image forming apparatuses such as an image display apparatus and an image recording apparatus, an electron beam source and the like, to which a surface conduction electron emission device is applied, have been studied.

The inventors have examined surface conduction electron emission devices of various materials, manufacturing methods and structures. Moreover, the inventors have studied a multi-electron beam source (also referred to simply as electron source), in which a large number of surface conduction electron emission devices are arranged, and an image display apparatus to which this electron source is applied.

For example, the inventors have attempted to manufacture an electron source according to an electric wiring method shown in FIG. 19. FIG. 19 is a view explaining matrix wiring of a conventional multi-electron source.

In FIG. 19, reference numeral 4001 denotes schematically shown surface conduction electron emission devices; 4002 denotes row direction wiring; and 4003 denotes column direction wiring. In the figure, wiring resistances are denoted by 4004 and 4005.

The wiring method as described above is called passive matrix wiring. Note that, although the wiring is shown as a 6×6 matrix for convenience of illustration, a size of the matrix is not limited to this of course.

In the electron source in which devices are arranged in passive matrix, an appropriate electric signal is applied to the row direction wiring 4002 and the column direction wiring 4003 in order to output a desired emission current. In addition, at the same time, a high voltage is applied to an anode electrode (not shown).

For example, in order to drive arbitrary devices in matrix, a selection voltage Vs is applied to terminals of the row direction wiring 4002 of rows to be selected, and at the same time, a non-selection voltage Vns is applied to terminals of the row direction wiring 4002 of rows not to be selected.

In synchronous with this, modulation voltages Ve1 to Ve6 for outputting emission currents are applied to terminals of the column direction wiring 4003. According to this method, voltages of Ve1-Vs to Ve6-Vs are applied to the devices to be selected and voltages of Ve1-Vns to Ve6-Vns are applied to the devices not to be selected.

Here, if Ve1 to Ve6, Vs and Vns are set to appropriate magnitudes such that a voltage equal to or higher than the threshold voltage Vth is applied to the devices to be selected and a voltage equal to or lower than the threshold voltage Vth is applied to the devices not to be selected, an emission current of a desired strength is outputted only from the devices to be selected.

Therefore, the multi-electron source in which surface conduction electron emission devices are arranged in passive matrix has a possibility that it can be applied in various ways. For example, if an electric signal according to image information: is appropriately applied, the multi-electron source can be preferably used as an electron source for an image display apparatus.

The multi-electron source manufactured in this way causes slight fluctuation in an emission characteristic of respective electron sources due to variation in a process, or the like.

Such a multi-electron source is preferable for manufacturing a flat image forming apparatus of a large screen. However, since there are a large number of electron sources unlike a CRT or the like, if an image forming apparatus is manufactured using this, there is a problem in that fluctuation of characteristics of respective electron sources appears as fluctuation of luminance.

As described above, as reasons why an electron emission characteristic in a multi-electron source is different for each electron source, various causes are possible such as fluctuation of components of a material used in an electron emitting region, an error of a dimension and shape of each member of the device, nonuniformity of energization conditions in an energization forming operation, and nonuniformity of energization conditions and an atmospheric gas in an energization activation process.

However, a highly advanced manufacturing facility and an extremely strict process management are required if it is attempted to remove all of these causes. If these are satisfied, manufacturing costs increase enormously. Thus, it is not realistic to remove all of these causes.

In Japanese Patent Application Laid-Open No. 10-228867 and the like, a method is disclosed which provides a process of measuring respective characteristics in order to control the fluctuation and a process of applying a characteristic shift voltage for adjusting a characteristic to obtain a value corresponding to a reference value.

However, in the process of measuring characteristics in the invention disclosed in Japanese Patent Application Laid-Open No. 10-228867 and the like, as shown in FIG. 20 (flow chart), there is a process of selecting a device (step 2007), applying a voltage to measure the emission current Ie and luminance (step 2004), saving a result of the measurement in a memory (step 2005) and repeating this measurement operation for all the devices (step 2008). FIG. 20 is a flow chart of a characteristics measurement process in a characteristic adjustment method of the conventional invention.

It is likely that such a process of measuring characteristics of devices for each device takes a long time if the process is used in a high resolution image forming apparatus such as a high definition TV these days, that is, if the number of pixels is large.

Moreover, if luminance is used as a parameter indicating an indicator of nonuniformity, there is an effect that fluctuation of a partial light-emitting characteristic of a phosphor can also be corrected. However, if P22 that is a phosphor generally used in a CRT is used, the red phosphor has 1/10 afterglow time of approximately 10 μs for green and blue and 1 ms for red.

If light emission from one device is measured using an optical system one by one, since there is the afterglow time, it is necessary to set a time interval for driving a certain device and the next device to be equivalent to at least the afterglow time.

Therefore, if a high definition display having pixels of approximately 1,280×RGB×768 is constituted, it takes a long time, approximately 1,000 seconds, for measuring all the points.

SUMMARY OF THE INVENTION

The present invention has been devised in view of the above and other drawbacks, and it is an object of the present invention to provide a characteristic adjustment method for an image forming apparatus, a manufacturing method for an image forming apparatus and a characteristic adjustment apparatus for an image forming apparatus that are capable of adjusting characteristics of a multi-electron source with a simple process and making an in-plane light emission characteristic of image display uniform.

The present invention relates to a characteristic adjustment method for an image forming apparatus that is provided with a multi-electron source in which a plurality of electron-emitting devices are electrically connected by wiring and arranged on a substrate and a fluorescent member for emitting light by irradiation of an electron beam, characterized by including: a measurement step of dividing a display portion of said image forming apparatus into a plurality of areas and measuring light emitting characteristics of at least one or more of said electron-emitting devices in the respective divided areas; and a shifting step of shifting the light emitting characteristics of said electron-emitting devices in said divided areas to individual characteristic target values by applying a characteristic shift voltage to said electron-emitting devices.

Also, the present invention relates to a manufacturing method for an image forming apparatus that is provided with a multi-electron source in which a plurality of electron-emitting devices are electrically connected by wiring and arranged on a substrate and a fluorescent member for emitting light by irradiation of an electron beam, characterized by including: a step of forming a plurality of electrodes for electron-emitting devices and electroconductive films on said substrate; a step of forming electron-emitting portions of said plurality of electron-emitting devices by energizing said electroconductive films via said electrodes for electron-emitting devices; a step of activating said electron-emitting portions; and a step of performing said characteristic adjustment method of the above image forming apparatus.

Also, the present invention relates to a characteristic adjustment apparatus for an image forming apparatus that is provided with a multi-electron source in which a plurality of electron-emitting devices are electrically connected by wiring and arranged on a substrate and a fluorescent member for emitting light by irradiation of an electron beam, characterized by including: selecting and driving means for selecting and driving a plurality of electron-emitting devices in rectangular areas of a display portion of said image forming apparatus; timing signal generating means synchronous with a driving time of said selecting and driving means; at least one luminance measuring means for capturing a light emitting signal of light emitting means, which emits light by electrons emitted form said electron-emitting devices, in synchronous with an output of said timing signal generating means; arithmetic operation means for finding light emitting characteristics of said selected electron-emitting devices from a value of the light emitting signal captured by said luminance measuring means and selecting information used by said selecting and driving means in selecting said electron-emitting devices; storing means for storing an output of said arithmetic operation means; voltage applying means for applying a voltage to said selected electron-emitting devices based on the light emitting characteristics found by said arithmetic operation means; and at least one or more moving means for relatively moving said luminance measuring means and said display portion.

The present invention relates to a characteristic adjustment apparatus for an image forming apparatus that is provided with a multi-electron source in which a plurality of electron-emitting devices are electrically connected by wiring and arranged on a substrate and a fluorescent member for emitting light by irradiation of an electron beam, characterized by including: at least one or more luminance measurement apparatus that is capable of, in the case where a display portion of said image forming apparatus is divided into a plurality of areas, measuring luminance of electron-emitting devices of the entire one area among the plurality of areas without moving; a control circuit for calculating a characteristic shift voltage to be applied to said electron-emitting devices based on a relationship between a drive voltage applied to said electron-emitting devices and luminance measured by said luminance measurement apparatus; and applying means for applying said characteristic shift voltage to said electron-emitting devices.

DESCRIPTION OF THE PREFERRED EMBODIMENTS

Figure 1:
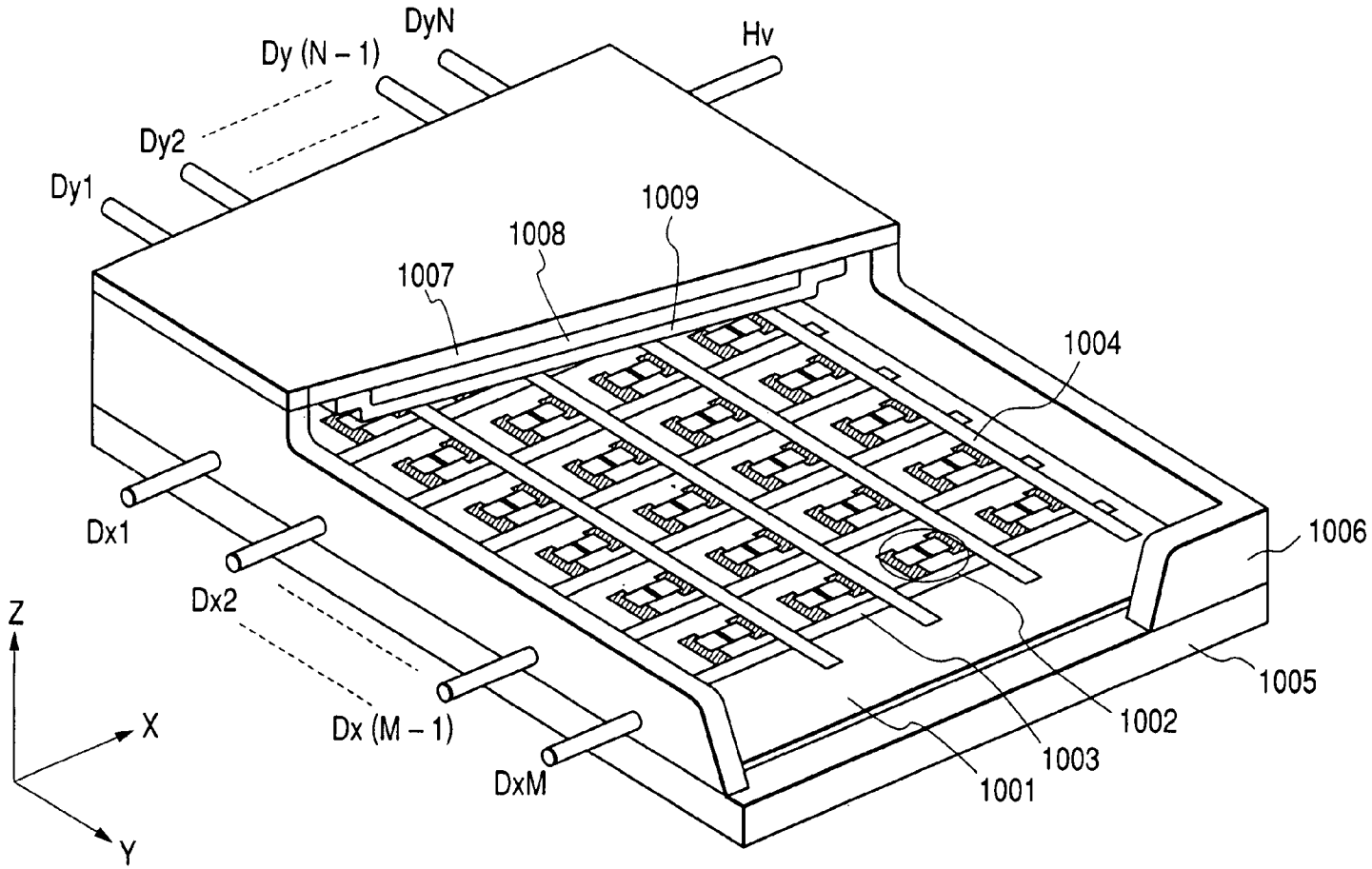
FIG. 1 is a perspective view showing a display panel of an image forming apparatus partly cut away, which is used for a characteristic adjustment method for an image forming apparatus of the present invention.

A characteristic adjustment method for an image forming apparatus in accordance with the present invention that is provided with a multi-electron source in which a plurality of electron-emitting devices are electrically connected by wiring and arranged on a substrate and a fluorescent member for emitting light by irradiation of an electron beam, is characterized by including: a measurement step of dividing a display portion of the image forming apparatus into a plurality of areas and measuring light emitting characteristics of at least one or more of the electron-emitting devices in the respective divided areas; and a shifting step of shifting the light emitting characteristics of the electron-emitting devices in the divided areas to individual characteristic target values by applying a characteristic shift voltage to the electron-emitting devices.

Also, a characteristic adjustment method for an image forming apparatus in accordance with the present invention is characterized in that the measurement step includes: a luminance measurement step of applying a drive voltage to the electron-emitting devices to measure luminance of the electron-emitting devices; and a calculation step of comparing a relationship between the drive voltage and the luminance of the measured electron-emitting devices and a relationship between a drive voltage and luminance of at least one or more electron-emitting devices with different initial characteristics, selecting electron-emitting devices with an initial characteristic that substantially coincides with the initial characteristic of the measured electron-emitting devices, and calculating a characteristic shift voltage to be applied to the measured electron-emitting devices based on a relationship between a characteristic shift voltage to be applied to the selected electron emitting-devices and an emission current from the selected electron-emitting devices.

Also, a characteristic adjustment method for an image forming apparatus in accordance with the present invention is characterized in that the measurement step is a step of driving a plurality of electron-emitting devices among the electron-emitting devices in the divided areas simultaneously to measure luminance.

Also, a characteristic adjustment method of an mage forming apparatus in accordance with the present invention is characterized in that the measurement step is a step of selecting at least one or more electron-emitting devices out of electron-emitting devices in different divided areas among the divided areas and measuring a relationship between a drive voltage and luminance of the electron-emitting devices in the different divided areas among the divided areas simultaneously.

Also, a characteristic adjustment method for an image forming apparatus in accordance with the present invention is characterized in that the measurement of luminance in the measurement step is performed by a luminance measurement apparatus that is capable of measuring luminance of at lease one or more electron-emitting devices in each of the divided areas without moving.

Also, a characteristic adjustment method of an image forming in accordance with the present invention is characterized in that the shifting step includes a step of selecting at least one or more electron-emitting devices out of electron-emitting devices in different divided areas among the divided areas and applying a characteristic shift voltage to each of the electron-emitting devices in the different divided areas among the divided areas simultaneously.

Moreover, a manufacturing method for an image forming apparatus in accordance with the present invention that is provided with a multi-electron source in which a plurality of electron-emitting devices are electrically connected by wiring and arranged on a substrate and a fluorescent member for emitting light by irradiation of an electron beam, is characterized in that: a step of forming a plurality of electrodes for electron-emitting devices and electroconductive films on the substrate; a step of forming electron-emitting portions of the plurality of electron-emitting devices by energizing the electroconductive films via the electrodes for electron-emitting devices; a step of activating the electron-emitting portions; and a step of performing the characteristic adjustment method of the above image forming apparatus.

Further, an image forming apparatus in accordance with the present invention is characterized in that a characteristic shift voltage is applied to an electron-emitting device and a characteristic is adjusted by the characteristic adjustment method of the above image forming apparatus.

Moreover, a characteristic adjustment apparatus in accordance with the present invention that is provided with a multi-electron source in which a plurality of electron-emitting devices are electrically connected by wiring and arranged on a substrate and a fluorescent member for emitting light by irradiation of an electron beam, is characterized by including: selecting and driving means for selecting and driving a plurality of electron-emitting devices in rectangular areas of a display portion of the image forming apparatus; timing signal generating means synchronous with a driving time of the selecting and driving means; at least one luminance measuring means for capturing a light emitting signal of light emitting means, which emits light by electrons emitted form the electron-emitting devices, in synchronous with an output of the timing signal generating means; arithmetic operation means for finding light emitting characteristics of the selected electron-emitting devices from a value of the light emitting signal captured by the luminance measuring means and selecting information used by the selecting and driving means in selecting the electron-emitting devices; storing means for storing an output of the arithmetic operation means; voltage applying means for applying a voltage to the selected electron-emitting devices based on the light emitting characteristics found by the arithmetic operation means; and at least one or more moving means for relatively moving the luminance measuring means and the display portion.

Also, a characteristic adjustment apparatus in accordance with the present invention is characterized in that the selecting and driving means drives a plurality of electron-emitting devices among electron-emitting devices in the divided areas simultaneously.

Also, a characteristic adjustment apparatus in accordance with the present invention is characterized in that the voltage applying means is capable of simultaneously applying different voltages to the electron emitting devices in the rectangular areas, respectively.

Also, a characteristic adjustment apparatus in accordance with the present invention that is provided with a multi-electron source in which a plurality of electron-emitting devices are electrically connected by wiring and arranged on a substrate and a fluorescent member for emitting light by irradiation of an electron beam, is characterized by including: at least one or more luminance measurement apparatus that is capable of, in the case where a display portion of the image forming apparatus is divided into a plurality of areas, measuring luminance of electron-emitting devices of the entire one area among the plurality of areas without moving; a control circuit for calculating a characteristic shift voltage to be applied to the electron-emitting devices based on a relationship between a drive voltage applied to the electron-emitting devices and luminance measured by the luminance measurement apparatus; and applying means for applying the characteristic shift voltage to the electron-emitting devices.

Also, a characteristic adjustment apparatus in accordance with the present invention is characterized in that the luminance measurement apparatus measures luminance of a plurality of electron-emitting devices, which are simultaneously driven, in the divided areas.

Also, a characteristic adjustment apparatus in accordance with the present invention is characterized in that the control circuit is provided with a memory for storing a relationship between luminance and a drive voltage of at least one or more electron-emitting devices with different initial characteristics and storing, for each of the electron-emitting devices with different initial characteristics, a relationship between a characteristic shift voltage to be applied to the electron-emitting device and an emission current from the electron-emitting device, selects a relationship between the luminance and the drive voltage stored in the memory with which a relationship between the luminance and the drive voltage of the electron-emitting devices whose luminance is measured substantially coincides, and calculates a characteristic shift voltage to be applied to the measured electron-emitting devices based on a relationship between the characteristic shift voltage of an electron-emitting device, which has the selected relationship between the luminance and the drive voltage, and an emission current from the electron-emitting device.

Moreover, the image forming apparatus in accordance with the present invention is characterized in that a characteristic shift voltage is applied to an electron-emitting device and a characteristic is adjusted by the characteristic adjustment apparatus.

That is, the characteristic adjustment method for an image forming apparatus in accordance with the present invention is a characteristic adjustment method for an image forming apparatus using an electron source in which a plurality of electron-emitting devices are electrically connected by wiring and arranged on a substrate in order to attain the above-mentioned objects, which is characterized by including a measurement step of measuring light emitting characteristics of a plurality of electron-emitting devices at the time of driving the electron source simultaneously, a step of finding an individual light emitting characteristics distribution of each electron-emitting device from the measured light emitting characteristics and a shifting step of shifting the light emitting characteristics of the plurality of electron-emitting devices to a target value by application of a characteristic shift voltage.

Moreover, the characteristic adjustment method for an image forming apparatus in accordance with the present invention has a step of relatively moving a position of a display panel and means-for obtaining a light emitting characteristic.

(Actions)

In an image forming apparatus having a multi-electron source, in which a plurality of surface conduction electron emission devices are electrically connected by wiring and arranged on a substrate, and a fluorescent member that emits light by irradiation of an electron beam, a plurality of surface conduction electron emission devices of desired addresses are driven by selecting and driving means simultaneously with respect to an area in a measurement sight of a luminance measurement apparatus which is a part of a screen.

Electrons emitted from the driven surface conduction electron emission devices reach light emitting means and emit light.

Bright spots corresponding to the driven electron-emitting devices are formed on the light emitting means. A signal of two-dimensional bright spots is photoelectrically converted by using timing signal generating means having a signal synchronous with a drive time as an output for a synchronizing signal and using luminance measuring means.

A luminance characteristic value corresponding to the respective driven surface conduction electron emission devices is calculated from the photoelectrically converted two-dimensional luminance signal and an address of a drive device using arithmetic operation means.

Comparison of fluctuation of a luminance characteristic value and a target value of characteristic adjustment is performed, and a characteristic shift voltage is applied only to a surface conduction electron emission device in which the luminance characteristic value has not reached a reference value.

A characteristic of the electron-emitting device to which the shift voltage is applied is adjusted to a target light emitting characteristic.

Selection of a device to be driven by selecting and driving means is changed, and all characteristics of the devices within luminance measurement sight are adjusted.

Moreover, relative positions of the luminance measuring means and the image forming apparatus are changed to change the measurement sight. The above-mentioned process is repeated, whereby a uniform characteristic is given across the entire area of the image forming apparatus.

Moreover, if a plurality of luminance measurement apparatuses are provided and wiring is constituted in a passive matrix configuration, devices in areas corresponding to the plurality of luminance measurement apparatuses, respectively, are simultaneously selected and driven.

Luminance characteristic values corresponding to the driven devices are measured in the same manner as the case where there is only one luminance measurement apparatus.

A shift voltage is applied only to a device whose luminance characteristic is not adjusted to the target value. This process is sequentially repeated with respect to the sights.

Figure 9:
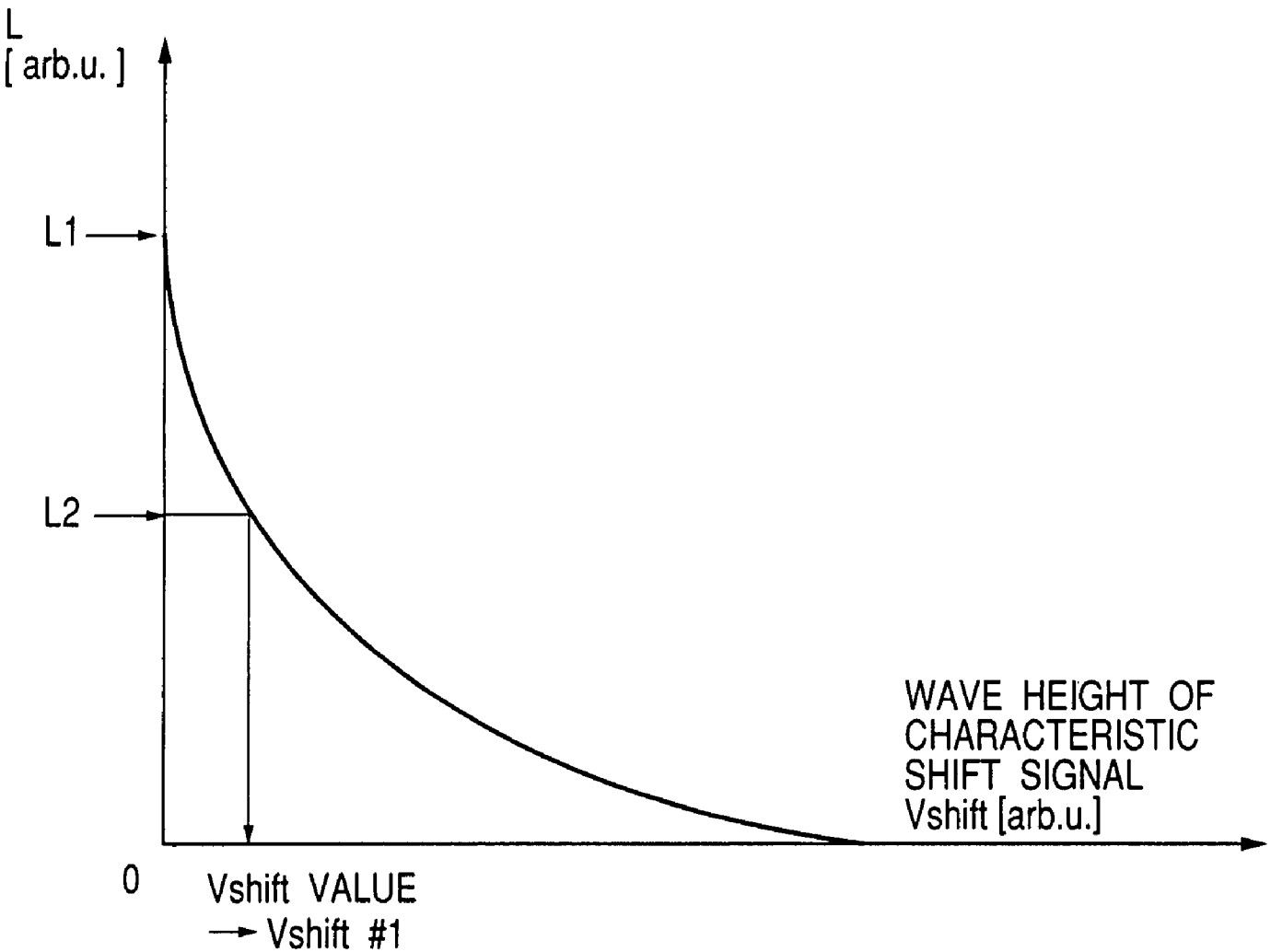
FIG. 9 is a graph showing changes in a wave height value of a characteristic shift pulse voltage and an emission current.

When the image forming apparatus, whose characteristics are adjusted by applying a characteristic shift voltage as described above, is driven by a drive voltage Vf of a value lower than a wave height value of a characteristic shift voltage of any device, an image forming apparatus in which light emission luminance by all the surface conduction electron-emitting devices are uniform can be obtained. Here, a relationship between a characteristic shift voltage to be applied to the electron-emitting device and an emission current from the electron-emitting device is a relationship between a change in the characteristic shift voltage and a change in the emission current if a constant drive current is applied to the electron-emitting device, for example, as shown in FIG. 9.

Preferred embodiments of the present invention will be hereinafter described in detail illustratively with reference to the accompanying drawings. However, dimensions, materials, shapes and a relative arrangement of components described in the embodiments are not meant to limit a scope of the present invention only to them unless specifically described otherwise.

In addition, in the drawings referred to below, the same members as those described in the figures already referred to are denoted by the same reference numerals. Further, the following descriptions of each embodiment of a characteristic adjustment method for an image forming apparatus in accordance with the present invention also serves as descriptions of each embodiment of a manufacturing method for an image forming apparatus, an image forming apparatus and a characteristic adjustment apparatus in accordance with the present invention.

First Embodiment of the Characteristic Adjustment Method for an Image Forming Apparatus A first embodiment of a characteristic adjustment method for an image forming apparatus in accordance with the present invention will be hereinafter described. In the embodiment described below, an example in which the present invention is applied to an image forming apparatus using a multi-electron beam source is shown.

First, a structure and a manufacturing method of a display panel of the image forming apparatus to which the present invention is applied will be described.

(A Structure and a Manufacturing Method of a Display Panel).

FIG. 1 is a perspective view of a display panel of the image forming apparatus to which the present invention is applied, in which a part of the panel is cut away in order to show its internal structure.

In the figure, reference numeral 1005 denotes a rear plate; 1006, a sidewall; and 1007, a face plate. An airtight container for maintaining the inside of the display panel vacuum is formed by the rear plate 1005, the sidewall 1006 and the face plate 1007. In assembling the airtight container, it is necessary to seal joining portions of each member to cause them to hold sufficient strength and airtightness. For example, sealing was attained by applying frit glass on the joining portions and baked for 10 minutes or more under the temperature of 400 to 500° C. in the atmosphere or a nitrogen atmosphere.

A substrate 1001 is fixed to the rear plate 1005, and m×n pieces of surface conduction electron emission devices are formed on the substrate. The numbers m and n are appropriately set according to a target number of display pixels. In this embodiment, it was assumed that m is 3,840 and n is 768.

Figure 2:
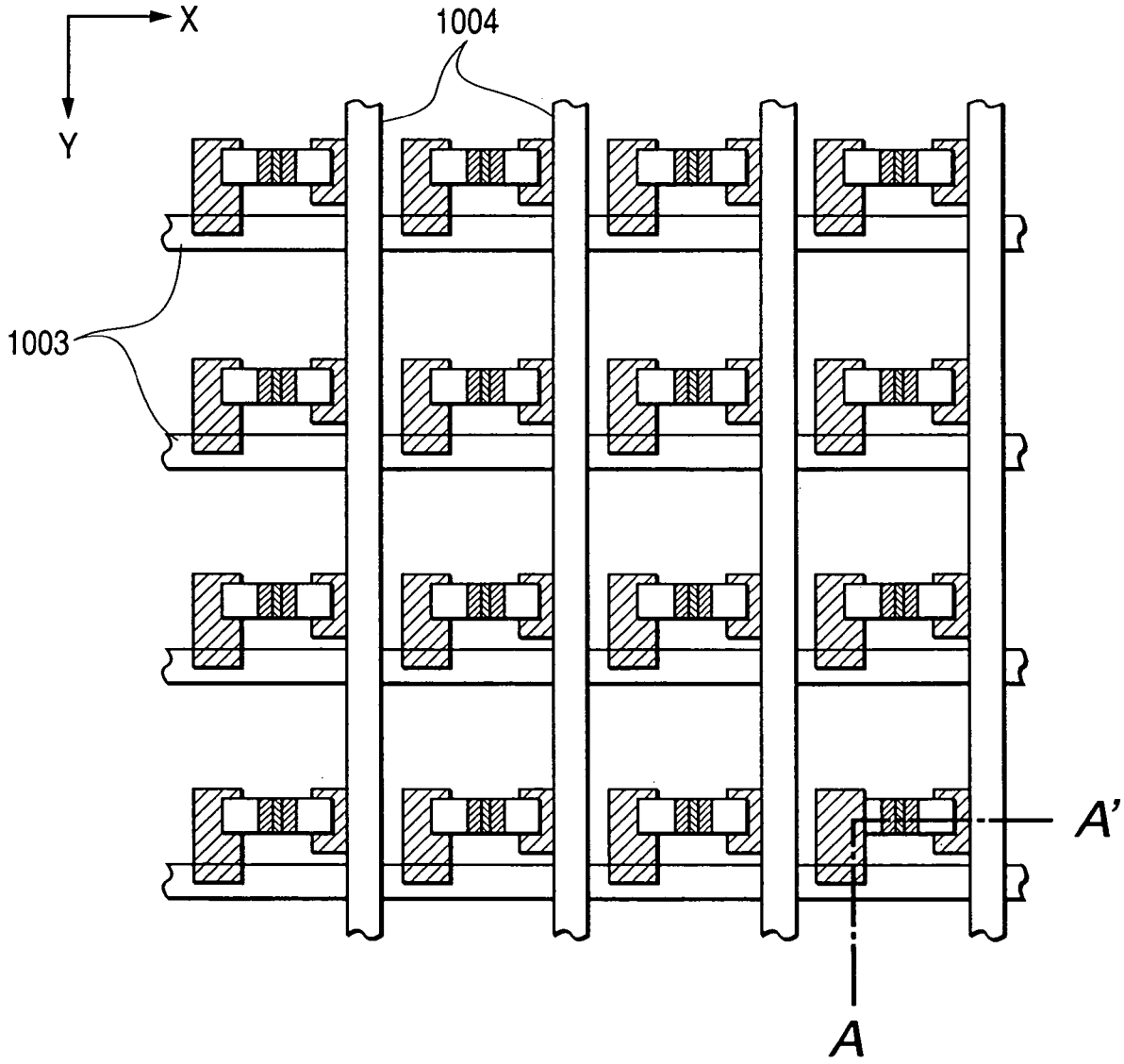
FIG. 2 is a plan view of a substrate of a multi-electron source of the image forming apparatus shown in FIG. 1.

A portion constituted by components denoted by reference numerals 1001 to 1004 is called a multi-electron beam source. FIG. 2 shows a plan view of the multi-electron beam source of the image forming apparatus shown in FIG. 1.

The surface conduction electron emission devices 1002 as electron-emitting devices are arranged on the substrate 1001. These devices are wired in a passive matrix shape by row direction wiring electrodes 1003 and column direction wiring electrodes 1004.

Insulating layers (not shown) are formed between electrodes in parts where the row direction wiring electrodes 1003 and the column direction wiring electrodes 1004 intersect, whereby electric insulation is kept.

Further, the multi-electron beam source of such a structure is manufactured by feeding power to each device via the row direction wiring electrodes 1003 and the column direction wiring electrodes 1004 to perform an energization forming operation and an energization activation operation after forming the row direction wiring electrodes 1003, the column direction wiring electrodes 1004, the inter-electrodes insulating layers and device electrodes and electroconductive thin films of the surface conduction electron emission devices were formed on the substrate 1001 in advance.

A fluorescent film 1008 is formed below the face plate 1007 of FIG. 1. Since the image forming apparatus of this embodiment is a color display apparatus, phosphors of three primary colors of red, green and blue, which are used in the field of CRT, are separately coated in parts of the fluorescent film 1008.

Figure 3:
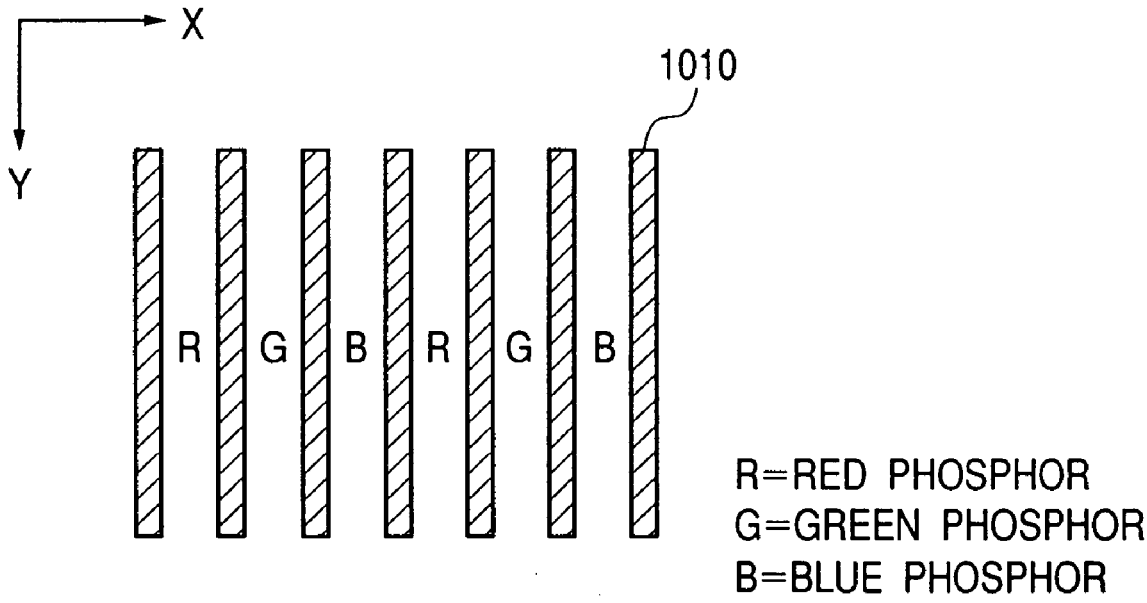
FIG. 3 is a plan view illustrating a phosphor arrangement of a face plate of the display panel of the image forming apparatus shown in FIG. 1.

As shown in FIG. 3, phosphors of each color are separately coated in a stripe shape, and black electric conductors 1010 are provided between each stripe of the phosphors. Therefore, an image forming apparatus having a resolution of 1,280×768 as the number of display pixels is formed. FIG. 3 is a plan view illustrating an arrangement of phosphors on the face plate of the display panel of the image forming apparatus shown in FIG. 1.

Purposes of providing the black electric conductor 1010 are to prevent dislocation from occurring in displayed colors even if an irradiation position of an electron beam is slightly dislocated, to prevent reflection of external light to keep display contrast from decreasing, to prevent charge-up of a fluorescent film by an electron beam, and the like.

Although graphite was used as a main component in the black electric conductor 1010, other materials may be used as long as they are suitable for the above-mentioned purposes. In addition, a way of separately coating the phosphors of three primary colors is not limited to the arrangement of a stripe shape shown in FIG. 3 but may be a delta shaped arrangement or arrangements other than that.

A metal back 1009 that is well known in the field of CRT is provided on a surface on the rear plate side of the fluorescent film 1008.

Purposes of providing the metal back 1009 are to perform mirror-reflection of a part of light emitted by the fluorescent film 1008 to improve a light utilization, to protect the fluorescent film 1008 from collision of negative ion, to cause it to act as an electrode for applying an electron beam acceleration voltage, to cause it to act as an electric conduction path of electrons that excite the fluorescent film 1008, and the like.

The metal back 1009 is formed by a method of forming the fluorescent film 1008 on the face plate 1007 and, then, applying a smoothing operation to the surface of the fluorescent film and depositing Al thereon by vacuum evaporation.

Dx1 to Dxm, Dy1 to Dyn and Hv are terminals for electric connection of an airtight structure provided for electrically connecting the display panel and an electric circuit (not shown).

The terminals Dx1 to Dxm, Dy1 to Dyn and Hv are electrically connected to the column direction wiring electrodes 1003 of the electron source, the row direction wiring electrodes 1004 of the electron source and the metal back 1009 of the face plate, respectively.

In order to evacuate the airtight container to be vacuum, after assembling the airtight container, an exhaust pipe (not shown) and vacuum pump are connected to evacuate the airtight container to a vacuum degree of approximately $1.0\times10^{-6}$ (Pa).

Thereafter, the exhaust pipe is sealed. In order to maintain a degree of vacuum in the airtight container, a getter film (not shown) is formed in a predetermined position in the airtight container immediately before or after the sealing.

The getter film is a film that is formed by heating and evaporating a getter material containing, for example, Ba as a main component by a heater or high frequency heating. A degree of vacuum in the airtight container is maintained to be approximately $1.0\times10^{-6}$ (Pa) by an absorptive action of the getter film. That is, the airtight container is in a stabilized state in which a partial pressure of organic matter is reduced.

The preferred embodiment of the present invention will be hereinafter described more in detail with reference to the accompanying drawings. As a result of earnestly conducting studies for improving characteristics of a surface conduction electron emission device, the inventors found that changes over time can be reduced by performing preliminary drive processing prior to usual driving in a manufacturing process.

Since the preliminary driving and characteristic adjustment of an electron source are integrated to be performed in this embodiment, the preliminary driving will be described first.

As described above, a device subjected to an energization forming operation and an energization activation operation is maintained in a stabilized state in which the partial pressure of organic matter is reduced.

An energization operation that is applied prior to normal driving in such an atmosphere in which the partial pressure of organic matter in a vacuum atmosphere is reduced (stabilized state) is the preliminary driving.

An electric field intensity in the vicinity of an electron-emitting region that is driving in a surface conduction electron emission device is extremely high. Thus, if an electron-emitting region drives for a long time under an identical drive voltage, an emitted electron amount gradually decreases. Changes over time in the vicinity of the electron-emitting region due to a high electric field intensity is considered to appear as a decrease in an emitted electron amount.

The preliminary driving means measuring an electric field intensity in the vicinity of an electron-emitting region of a device at the time of driving at a voltage of Vpre after driving a surface conduction electron emission device subjected to a stabilization process at the voltage Vpre.

Thereafter, usual driving is performed at a usual drive voltage Vdrv at which the electric field intensity is reduced. The electron-emitting region of the device is driven with a large electric field intensity in advance by driving by application of the Vpre voltage. Consequently, it is considered that changes of structural members, which become a cause of instability of characteristics over time at the time of long term driving at the usual drive voltage Vdrv, can intensively emerge in a short period to reduce variation factors.

In this embodiment, if there is fluctuation in characteristics of each electron-emitting device at the usual drive voltage Vdrv prior to use of the electron-emitting devices in the image forming apparatus, characteristics adjustment of each device is performed such that the fluctuation is reduced and the devices have a uniform distribution (a method of characteristics adjustment will be described later).

Figure 4:
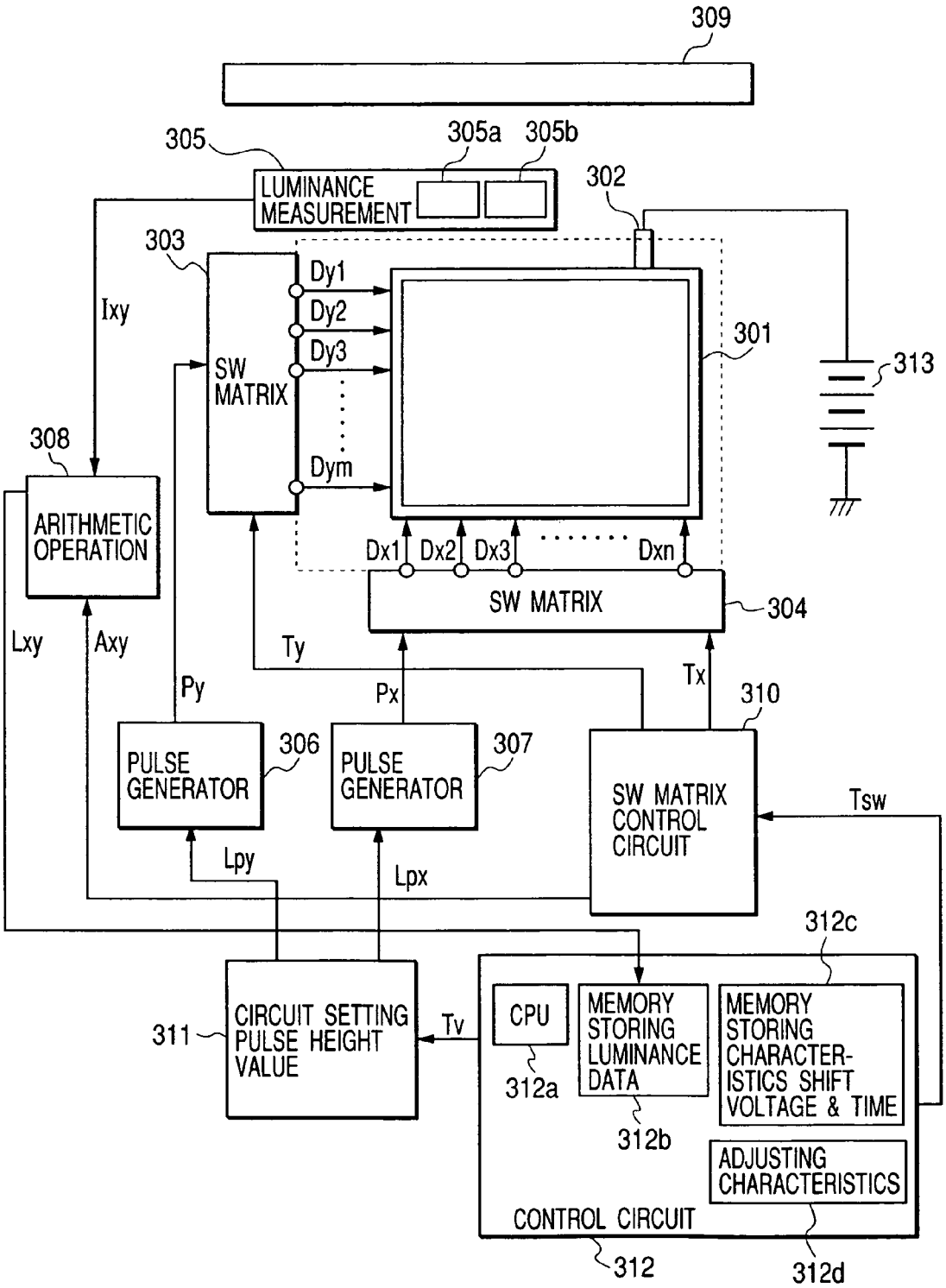
FIG. 4 is a schematic diagram showing an image forming apparatus using a multi-electron source and a characteristic adjustment apparatus for an image forming apparatus for applying a characteristic adjustment signal to this image forming apparatus, which are used in a first embodiment of the characteristic adjustment method for an image forming apparatus in accordance with the present invention.

FIG. 4 shows a structure of a drive circuit for applying a waveform signal for characteristics adjustment to each surface conduction electron emission device of the display panel 301 to change an electron-emitting characteristic of respective surface conduction electron emission devices of an electron source substrate. That is, FIG. 4 is a schematic diagram of an image forming apparatus using a multi-electron source and a characteristics adjustment apparatus for an image forming apparatus that applies a characteristics adjustment signal to this image forming apparatus.

In FIG. 4, reference numeral 301 denotes a display panel, in which a substrate having a plurality of surface conduction electron emission devices arranged in a matrix form, a face plate having phosphors that are provided on the substrate apart from each other and emit light by electrons emitted from the surface conduction electron emission devices, and the like are arranged in a vacuum container.

The preliminary drive voltage Vpre is applied to each device of the display panel 301 prior to characteristics adjustment. Reference numeral 302 denotes a terminal for applying a high voltage from a high voltage source 313 to the phosphors of the display panel 301.

Reference numerals 303 and 304 denote switch matrices, which select row direction wiring and column direction wiring, respectively, to select an electron-emitting device to which a pulse voltage is applied.

Reference numerals 306 and 307 denote pulse generation circuits, which generate pulse waveform signals Px and Py for driving.

Reference numeral 305 denotes a luminance measurement apparatus for capturing light emission of the image forming apparatus to perform photoelectric sensing, which consists of an optical lens 305*a* and an area sensor 305*b*.

In the present invention, a CCD is used as the area sensor 305*b*. A state of light emission of the image forming apparatus is electronically shown as two-dimensional image information using this optical system.

Reference numeral 308 denotes an arithmetic operation circuit. Two-dimensional image information Ixy that is an output of the area sensor 305*b* and positional information Axy designated in the switch matrices 303 and 304 are inputted in the arithmetic operation circuit 308 from a switch matrix control circuit 310, whereby the arithmetic operation circuit 308 calculates information of a light emission corresponding to each one of the driven surface conduction electron emission devices and outputs the information to a control circuit 312 as Lxy. Details of this method will be described later.

Reference numeral 309 denotes a robot system for relatively moving the area sensor with respect to the panel, which consists of a ball screw (not shown) and linear guide (not shown).

Reference numeral 311 denotes a circuit setting a pulse height value, which outputs pulse setting signals Lpx and Lpy, thereby determining a wave height value of pulse signals outputted from the pulse generator circuits 306 and 307, respectively. Reference numeral 312 denotes a control circuit, which controls the entire characteristics adjustment flow and outputs data Tv for setting a wave height value in the circuit setting a pulse height value. Further, reference numeral 312*a* denotes a CPU, which controls operations of the control circuit 312.

Reference numeral 312*b* denotes a memory storing luminance data for storing light emission characteristics of each device for characteristics adjustment of each device.

More specifically, the memory storing luminance data 312*b* stores light emission data that is proportional to luminance of light emitted by electrons emitted from each device at the time of applying the usual drive voltage Vdrv.

Reference numeral 312*c* denotes a memory for storing a characteristic shift voltage required for adjusting characteristics to target set values.

Reference numeral 312*d* denotes a lookup table (LUT) that is referred to in order to perform characteristics adjustment of a device, which will be described in detail later.

Reference numeral 310 denotes a switch matrix control circuit, which outputs switch changeover signals Tx and Ty to control selection of the switch matrices 303 and 304, thereby selecting an electron-emitting device to which a pulse voltage is applied. In addition, the switch matrix control circuit outputs address information Axy on which device is turned on to the arithmetic operation apparatus 308.

Next, operations of this drive circuit will be described. The operations of this circuit has a stage of measuring light emission luminance of each surface conduction electron emission device to obtain luminance fluctuation information required for attaining an adjustment target value and a stage for applying a pulse waveform signal for characteristic shift such that the adjustment target value is attained.

First of all, a method of measuring light emission luminance will be described. First, the luminance measurement apparatus 305 is moved to be positioned opposite to a display panel, on which it is desired to measure light emission luminance, by the robot system 309.

Next, the switch matrix control circuit 310 controls the switch matrices 303 and 304 to select predetermined row direction wiring or column direction wiring according to a switch matrix control signal Tsw from the control circuit 312, and the row direction wiring or the column direction wiring is switched to be connected such that a surface conduction electron-emitting device of a desired address can be driven.

On the other hand, the control circuit 312 outputs the wave height value data Tv for measuring electron emission characteristics to the circuit setting a pulse height value 311. Consequently, wave height value data Lpx and Lpy are outputted to the respective pulse generation circuits 306 and 307 from the circuit setting a pulse height value 311.

The respective pulse generation circuits 306 and 307 output drive pulses Px and Py based on the wave height value data Lpx and Lpy, and the drive pulses Px and Py are applied to the device selected by the switch matrices 303 and 304.

Here, the drive pulses Px and Py are set to have an amplitude of a half of a voltage (wave height value) Vdrv that is applied to a surface conduction electron emission device for characteristics measurement and have different polarities from each other. In addition, at the same time, a predetermined voltage is applied to phosphors of the display panel 301 by the high voltage power supply 313.

The processes of address selection and pulse application are repeated over a plurality of row wirings to drive a rectangular area of a display panel while scanning it.

Then, a signal Tsync indicating a period of the repeated processes is sent to an area sensor as a trigger of an electronic shutter.

Figure 5:
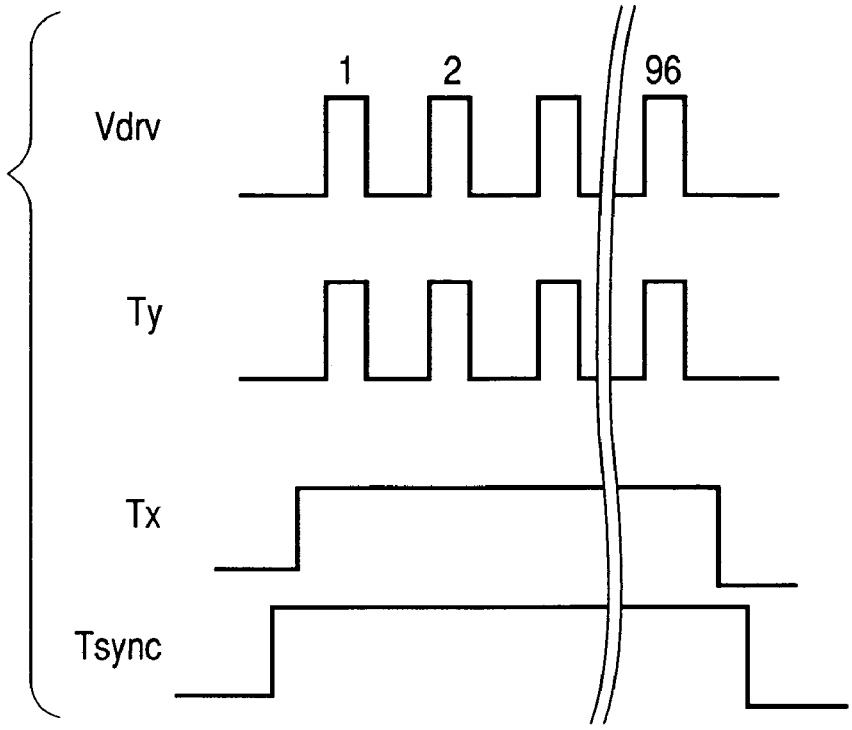
FIG. 5 is a drive timing chart in the characteristic adjustment apparatus of the image forming apparatus shown in FIG. 4.

That is, as shown in FIG. 5, the control circuit 312 outputs drive signals in synchronous with the switch changeover signals Tx and Ty and sequentially outputs the switch changeover signals Ty for the number of row wirings to be scanned. FIG. 5 is a drive timing chart in the characteristic adjustment apparatus for an image forming apparatus shown in FIG. 4.

The Tsync signal is outputted so as to cover the plurality of Ty signals. Since the shutter of the area sensor 305*b* is opened for a period during which the Tsync signal is at logical high, a lighted image reduced through the optical lens 305*a* is focused on the area sensor 305*b*.

Figure 6:
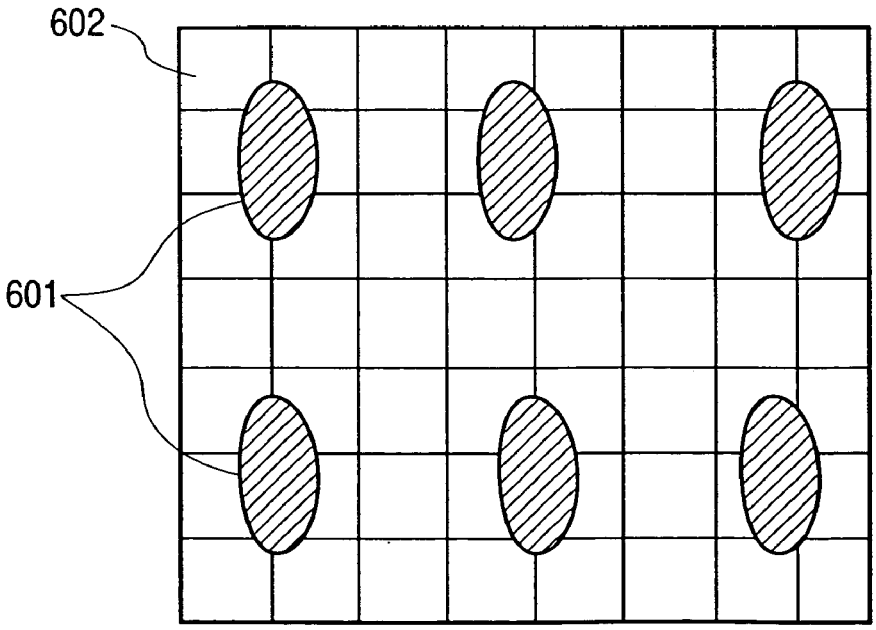
FIG. 6 is a schematic view showing a state in which bright spots on the image forming apparatus shown in FIG. 4 are projected on an area sensor.

FIG. 6 schematically shows a state described above. FIG. 6 is a schematic view showing a state in which bright spots on the image forming apparatus shown in FIG. 4 are projected on an area sensor.

A reduction ratio of an optical system is set such that an image is focused on a plurality of devices 602 of the area sensor with respect to one light emitting point 601.

This picked-up image Ixy is transferred to the arithmetic operation apparatus 308. Since images of driven device are focused, if a sum of CCD information allocated corresponding to respective devices is calculated for the number of devices, a luminance value proportional to a light emission amount of the respective driven devices is obtained. Since a luminance value corresponding to the devices of the driven rectangular area is obtained, information is sent to the control circuit 312 as Lxy.

Although the electronic shutter is also opened during an afterglow time of phosphors, influence of the afterglow time does not occur between light emitting points because the light emitting points are separated spatially on the area sensor.

Figure 7:
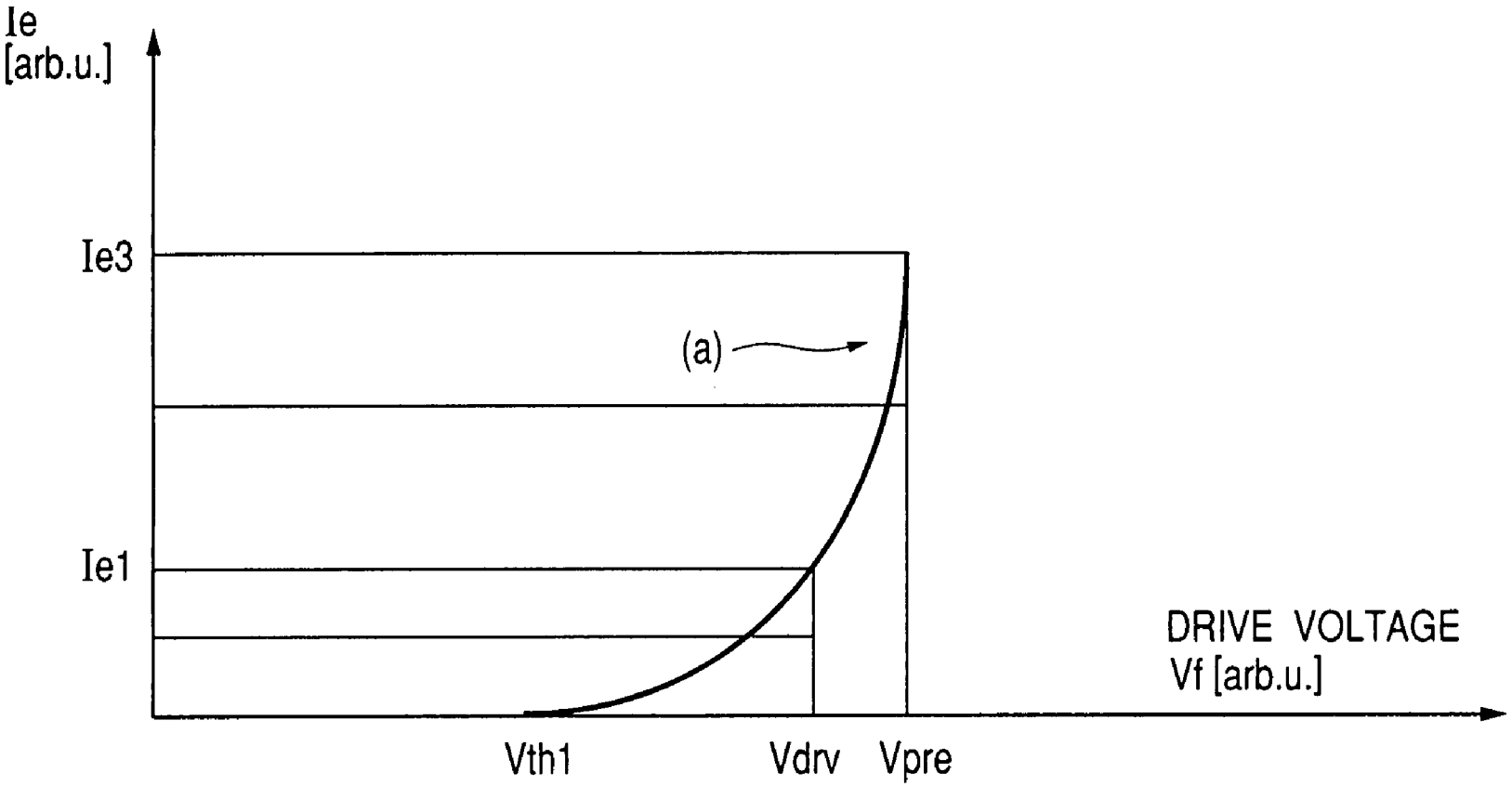
FIG. 7 is a graph showing an example of an emission current characteristic at the time when a drive voltage (wave height value of a drive pulse) Vf of each surface conduction electron emission device to which a preliminary drive voltage wave height value Vpre is applied during a process of manufacturing a multi-electron source of a display panel 301 by the characteristic adjustment method for an image forming apparatus in accordance with the present invention.
Figure 8:
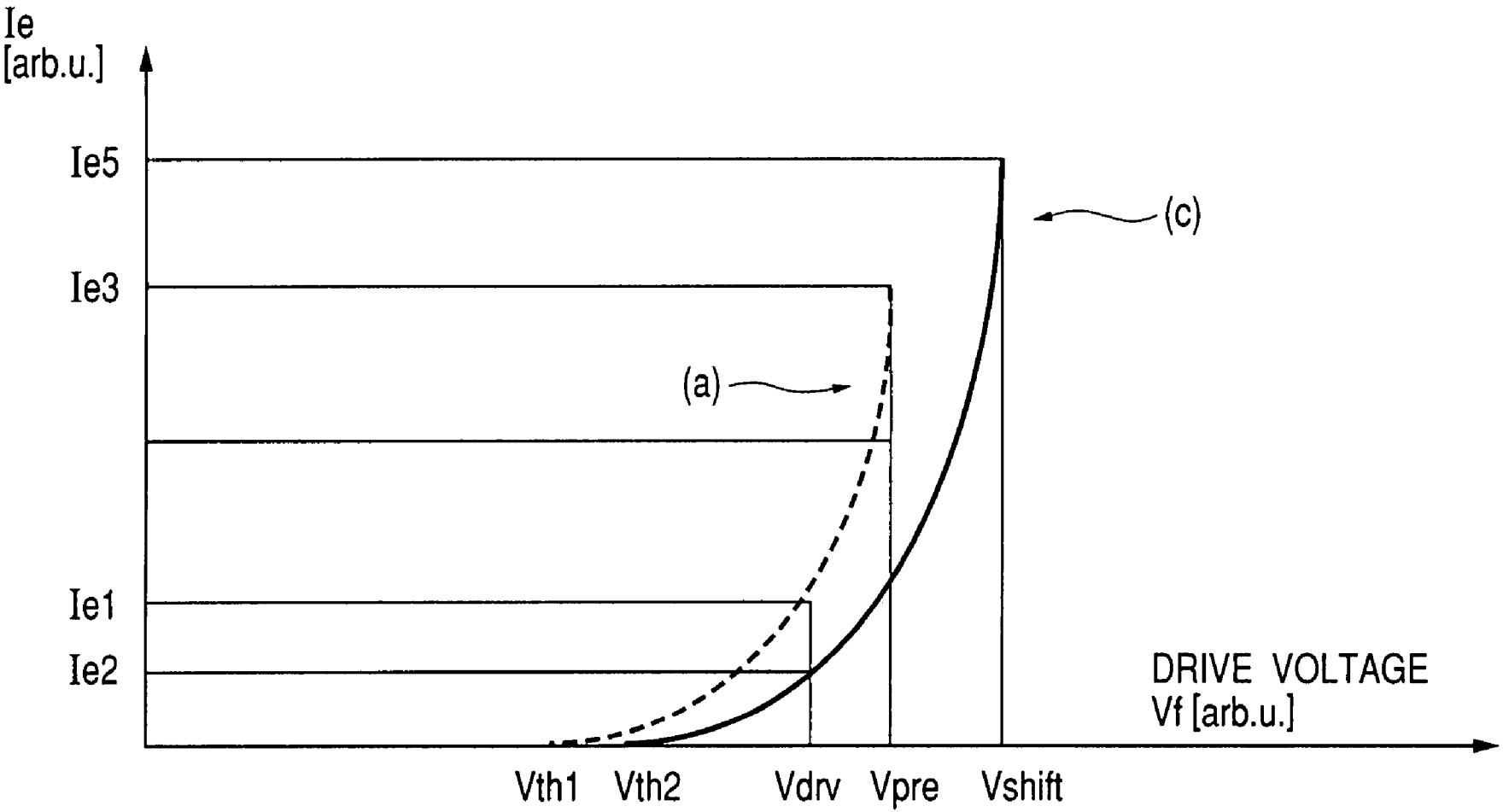
FIG. 8 is a graph showing a change in the emission current characteristic at the time when a characteristic shift voltage is applied to a device having the emission current characteristic of (a) in FIG. 7.

Next, the characteristic adjustment method used in this embodiment will be schematically described with reference to FIGS. 7, 8 and 9. FIG. 7 is a graph showing an example of an emission current characteristic at the time when the drive voltage (wave height value of a drive pulse) Vf of each surface conduction electron emission device, to which the preliminary drive voltage wave height value Vpre is applied, is changed during the process of manufacturing the multi-electron source of the display panel 301 by the characteristic adjustment method for an image forming apparatus in accordance with the present invention. FIG. 8 is a graph showing a change in an emission current characteristic at the time when a characteristic shift voltage is applied to a device having the emission current characteristic of (a) in FIG. 7. FIG. 9 is a graph showing changes in a wave height value of a characteristic shift pulse voltage (characteristic shift voltage) and an emission current.

In FIG. 7, an emission current characteristic of a certain surface conduction electron emission device is shown by an operation curve (a). An emission current at the time of the drive voltage Vdrv is Ie1 in an electron-emitting device having the emission characteristic of the curve (a).

On the other hand, the surface conduction electron emission device used in this embodiment has an emission current characteristic (memory functionality) corresponding to maximum wave height values and widths of drive pulses of voltages applied in the past.

FIG. 8 shows how the emission current characteristic changes when the characteristic shift voltage Vshift (Vshift≧Vpre) is applied to a device having the emission current characteristic of (a) kin FIG. 7 (curve (c) of FIG. 8).

It is understood that the emission current Ie at the time when Vdrv is applied decreases from Ie1 to Ie2 by the application of the characteristic shift voltage. That is, the emission current characteristic shifts in the right direction (in the direction in which an emission current decreases) by the application of the characteristic shift voltage.

Since a light emission amount with respect to an emission current depends on an acceleration voltage of electrons, a light emission efficiency of phosphors and a current density characteristic, if an amount taking these into account is referred to, the emission light characteristic can be shifted. In this embodiment, such characteristic adjustment was also performed.

In the first embodiment of the characteristic adjustment method for an image forming apparatus in accordance with the present invention, a light emission characteristic of each electron-emitting device is measured prior to using electron-emitting devices and, if there is fluctuation in electron emission characteristics, the electron emission characteristics are corrected to be uniform. A magnitude of a voltage applied to the electron-emitting devices in each process is set as described below.

That is, when a drive voltage for measurement that was applied in a process of measuring a light emission characteristic of each electron-emitting device, a characteristic shift voltage that was applied in a process of adjusting a characteristic of each electron-emitting device to be uniform and a maximum value of a drive voltage that was applied when the electron-emitting device was used were represented as VEmeasure, Vshift and Vdrive, respectively, these were set such that the following magnitude relationship was established.

$$Vdrive<VEmeasure<Vshift$$

In this way, since VEmeasure was set larger than Vdrive, a voltage larger than a drive voltage to be applied in use is applied to each electron-emitting device in advance prior to the use. Consequently, inconvenience in that an electron emission characteristic shifts during use can be prevented.

In addition, since Vshift is set larger than VEmeasure, a pulse for characteristic shift becomes a largest voltage applied to an electron-emitting device.

Therefore, if the pulse for characteristic shift is applied, an electron emission characteristic can be surely shifted to a desired characteristic.

It is needless to mention that, since Vshift is set larger than Vdrive, inconvenience in that an electron emission characteristic adjusted to be uniform is shifted during use can be prevented.

Incidentally, light emission luminance with respect to an electron emission current from a device depends on an acceleration voltage of electrons, a Current density and a light emission characteristic of phosphors. Thus, in order to learn how high characteristic shift voltage is applied to an electron-emitting device having a certain initial characteristic and, then, how much a characteristic curve shifts to the right direction, electron-emitting devices of various initial characteristics are selected, experiments are conducted by applying Vshift of various magnitudes to measure luminance, and various kinds of data are accumulated.

That is, although it is described using the graph with the emission current Ie on the vertical axis that characteristics of a device can be changed by applying a shift voltage, since the graph is known, a graph in the case in which the vertical axis represents luminance can also be determined.

Further, in the apparatus of FIG. 4, the various kinds of data are accumulated in the control circuit 312 as the lookup table 312*d* in advance.

FIG. 9 shows data of an electron-emitting device, which has the same initial characteristic as the initial characteristic shown as (a) in FIG. 7, picked up out of the lookup table and arranged as a graph.

The horizontal axis of this graph represents a magnitude of a characteristic shift voltage and the vertical axis represents light emission luminance L. This graph is a result of applying a drive voltage equal to Vdrv to measure an emission current after applying a characteristic shift voltage.

Therefore, in order to determine a magnitude of a characteristic shift voltage that should be applied to change light emission luminance of the device of (a) in FIG. 7, which emits light at L1 when Vdrv is applied, to L2, it is sufficient to read a Vshift value of a point where L is equal to L2 in the graph of FIG. 9 (in the figure, Vshift #1).

In this embodiment, the optical system and the robot system were designed such that the area of the display panel could be divided into sights of 10×8 lengthwise and sideways and measured.

In this embodiment, since a single color phosphor of one pixel was constituted in a size of 205 μm×300 micron with a width of the horizontal black stripe of 300 micron, the display area was approximately 790 mm×442 mm with 1,280×1,024 pixels.

Therefore, the robot system was designed such that the area could be scanned, and a magnitude of an optical system was set to 0.18.

Figure 10:
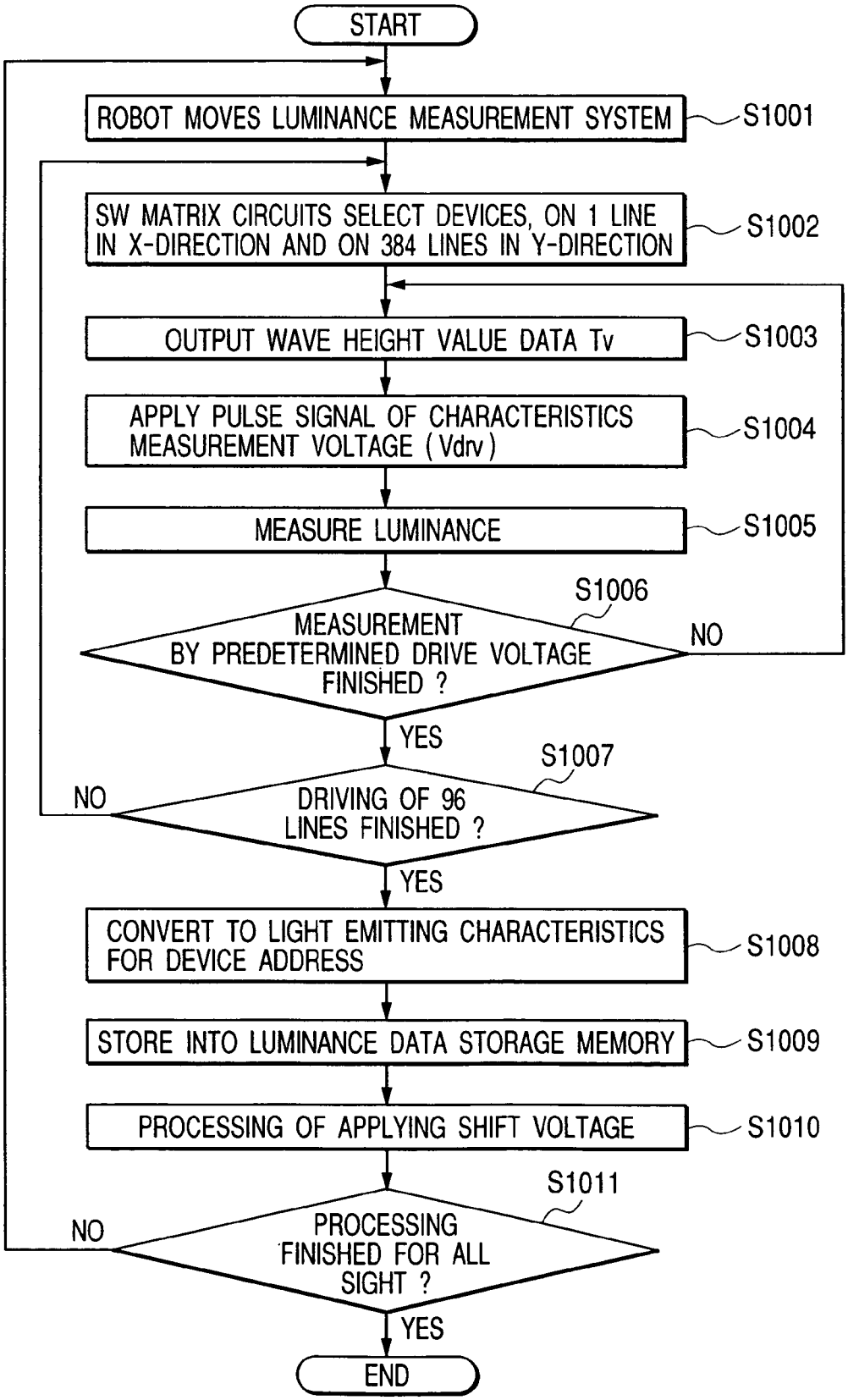
FIG. 10 is a flow chart showing characteristic adjustment operation for each surface conduction electron emission device of the electron source of the first embodiment of the characteristic adjustment method for an image forming apparatus in accordance with the present invention.

FIG. 10 is a flow chart showing characteristics measurement processing by the control circuit 312. This is a flow chart showing characteristic adjustment processing of each surface conduction electron emission device of an electron source of the first embodiment of the characteristic adjustment method for an image forming apparatus in accordance with the present invention.

First, in step 1001, a luminance measurement system is moved to a desired sight.

In step 1002, the switch matrix control signal. Tsw is outputted to switch the switch matrices 303 and 304 by the switch matrix control circuit 310 and select 384 surface conduction electron emission devices of the display panel 301.

Next, in step 1003, the wave height value data Tv of a pulse signal to be applied to the selected devices is outputted to the circuit setting a pulse wave height value 311. A wave height value of a pulse for measurement is the drive voltage Vdrv in performing image display.

Then, in step 1004, a pulse signal for characteristics measurement of an electron-emitting device is applied to the surface conduction electron emission devices selected in step 1002 from the pulse generation circuit 306 and 307 via the switch matrices 303 and 304.

Next, luminance with respect to the drive voltage is measured in step 1005.

Then, in step 1006, it is judged whether or not measurement of a luminance value with respect to a predetermined drive voltage is finished.

In this embodiment, a drive voltage was changed to measure luminance for a plurality of times under three conditions of Vdrv, Vdrv−0.5 Volt and Vdrv−1 Volt.

If the luminance measurement by the predetermined drive voltage is not finished, the processing from step 1003 to step 1005 is repeated until the luminance measurement by the predetermined drive voltage is finished. If the luminance measurement by the predetermined drive voltage is finished, the processing moves to step 1007.

The processing from step 1002 to step 1006 is repeated 96 times while sequentially changing row wiring to be designated (step 1007).

Next, in step 1008, the measured luminance is converted into luminance values corresponding to device addresses based on a light emitting image and addresses of driven devices. That is, 384×96 devices were driven and luminance values of the devices could be obtained. In step 1009, the luminance values are stored in the luminance data storage memory 312*b*.

In step 1010, processing of applying a shift voltage is performed. Details of this step will be described later. Up to this stage, processing of applying a shift voltage is finished for one sight.

In step 1011, it is checked if the luminance measurement and the processing of applying a shift voltage are finished for all the sights of the display panel 1. If not finished, the processing advances to step 1001, where the optical system is moved to the next sight and the processing is repeated.

The robot system 309 was used for the movement of the optical system, while the luminance measurement system was moved at the speed of 30 mm/sec.

Since one sight was approximately 80 mm×60 μm in size, it took approximately four seconds to move the luminance measurement system.

In this embodiment, Vdrv=14 V, Vpre=16 V and Vshift=16 to 0.18 V, and a short pulse with a pulse width of 1 ms and a period of 2 ms was used for the characteristic shift and a short pulse with a pulse width of 18 μs and a period of 20 μs was used for the luminance measurement.

As to the moving time and the time during which the devices are lighted, since the number of pulses outputted in measuring a luminance value of the entire screen is 96 per one sight and the number of sights is 80, the total number of pulses is 7,680. Thus, the drive time is 0.15 second. Since the moving time was four seconds per one sight and there were 80 sights, the total moving time was approximately 320 seconds.

In addition, since the application time of a shift voltage was 2 ms×the number of all devices, it was approximately 5,900 seconds.

Figure 11:
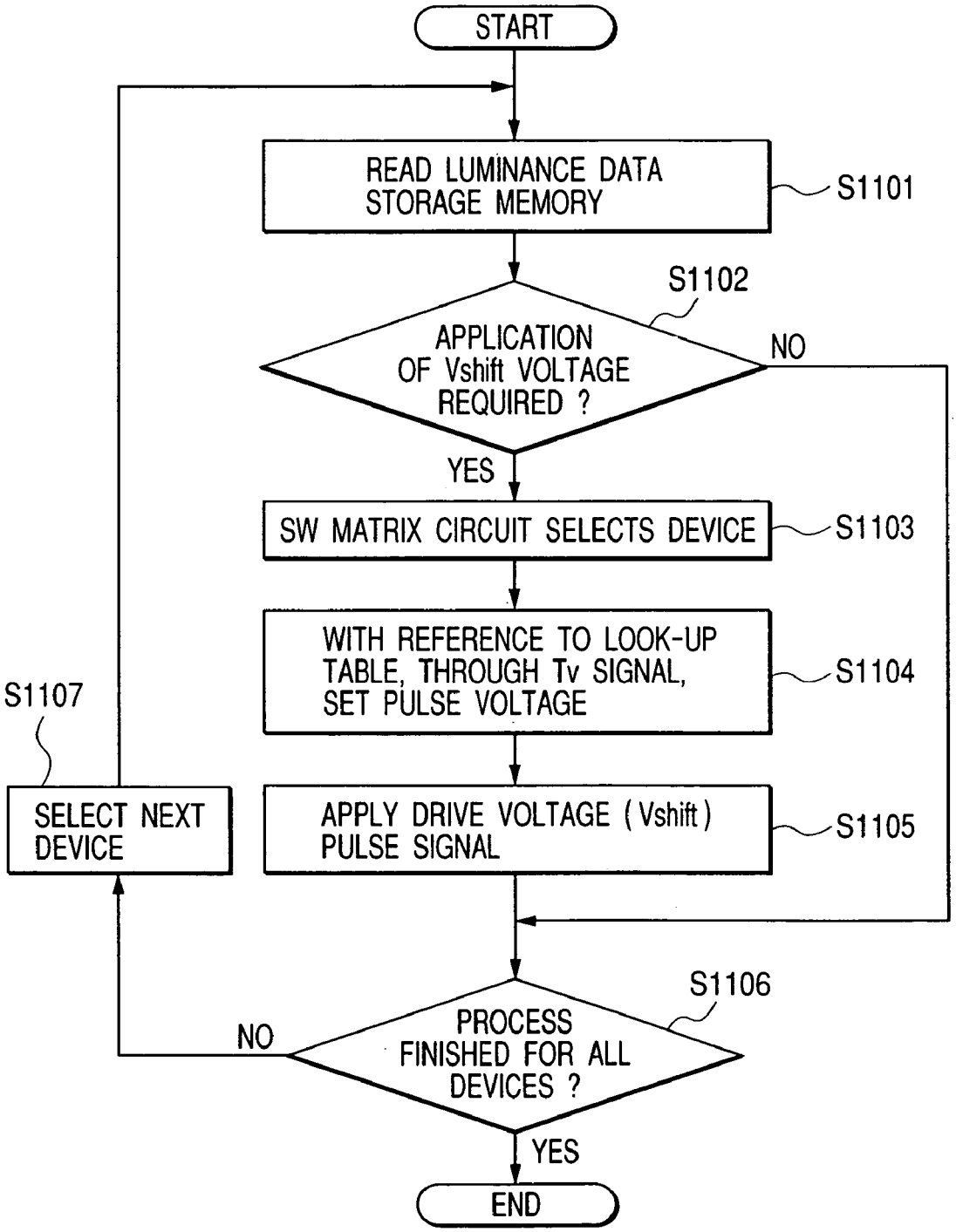
FIG. 11 is a flow chart showing processing for applying a characteristic adjustment signal based on an electron emission characteristic measured in the first embodiment of the characteristic adjustment method for an image forming apparatus in accordance with the present invention.

FIG. 11 is a flow chart showing processing for matching a luminance value of surface conduction electron emission devices within one sight of the display panel 301 to a target set value, which is executed by the control circuit 312 of this embodiment. The processing corresponds to step 1010 of FIG. 10. That is, FIG. 11 is a flow chart showing processing for applying a characteristic adjustment signal based on the electron emitting characteristic measured in the first embodiment of the characteristic adjustment method for an image forming apparatus in accordance with the present invention.

First, in step 1101, a luminance value measured by the luminance data storage memory 312*b* is read. In step 1102, it is judged whether or not it is required to apply a characteristic shift voltage to the surface conduction electron emission device, that is, if the measured luminance value is higher or lower than the target luminance value.

If the application of the shift voltage is required, the CPU 312*a* reads data of a device, which has an initial characteristic most approximate to that of the device, out of the lookup table 312*d*.

Here, since the initial characteristic is. Vf dependency of luminance, the CPU 312*a* measures changes Vf to measure luminance to find approximate curves of the luminance and compares approximate coefficients of the luminance to select data with values approximate to each other.

Then, the CPU 312*a* selects a characteristic shift voltage for equalizing a characteristic of the device to the target value out of the data.

In this case, it may be considered that there is usually only one type of an acceleration voltage and a light emitting characteristic of a phosphor for a certain product (there are three types, R, G and B, phosphors).

In addition, it may be considered that a relationship between an emission current and luminance (light emitting characteristic of a phosphor) is also determined substantially uniquely. Thus, a change in luminance with respect to a change in the device drive voltage Vf is an initial characteristic in the present invention.

Next, in step 1103, the switch matrices 303 and 304 are controlled by the switch matrix control signal Tsw via the switch matrix control circuit 312 to select one surface conduction electron emission device of the display panel 301.

A wave height value of a pulse signal is set in the circuit setting a pulse wave height value 311 through a wave height value set signal Tv. In step 1104, the circuit setting a pulse wave height value 311 outputs the wave height value data Lpx and Lpy, and the pulse generation circuits 306 and 307 output the drive pulses Px and Py of the set wave height value based on the value.

In this way, a value of a characteristic shift voltage is determined for respective devices, and a characteristic shift pulse, which corresponds to a characteristic of a surface conduction electron emission device for which the characteristic should be shifted, is applied to the surface conduction electron emission device (step 1105).

In step 1106, it is checked if the processing for all the surface conduction electron emission devices within one sight is finished. If not finished, the next device is selected (step 1107) and the processing returns to step 1101.

When an image forming apparatus manufactured by the above process was driven at Vdrv=14 Volts and luminance fluctuation of the entire surface was measured, a standard deviation/average value was 3%. In addition, a high definition image without the feeling of fluctuation could be displayed when a moving image was displayed on the panel.

Second Embodiment of the Characteristic Adjustment Method for an Image Forming Apparatus Next, a second embodiment of the characteristic adjustment method for an image forming apparatus in accordance with the present invention will be described.

Figure 12:
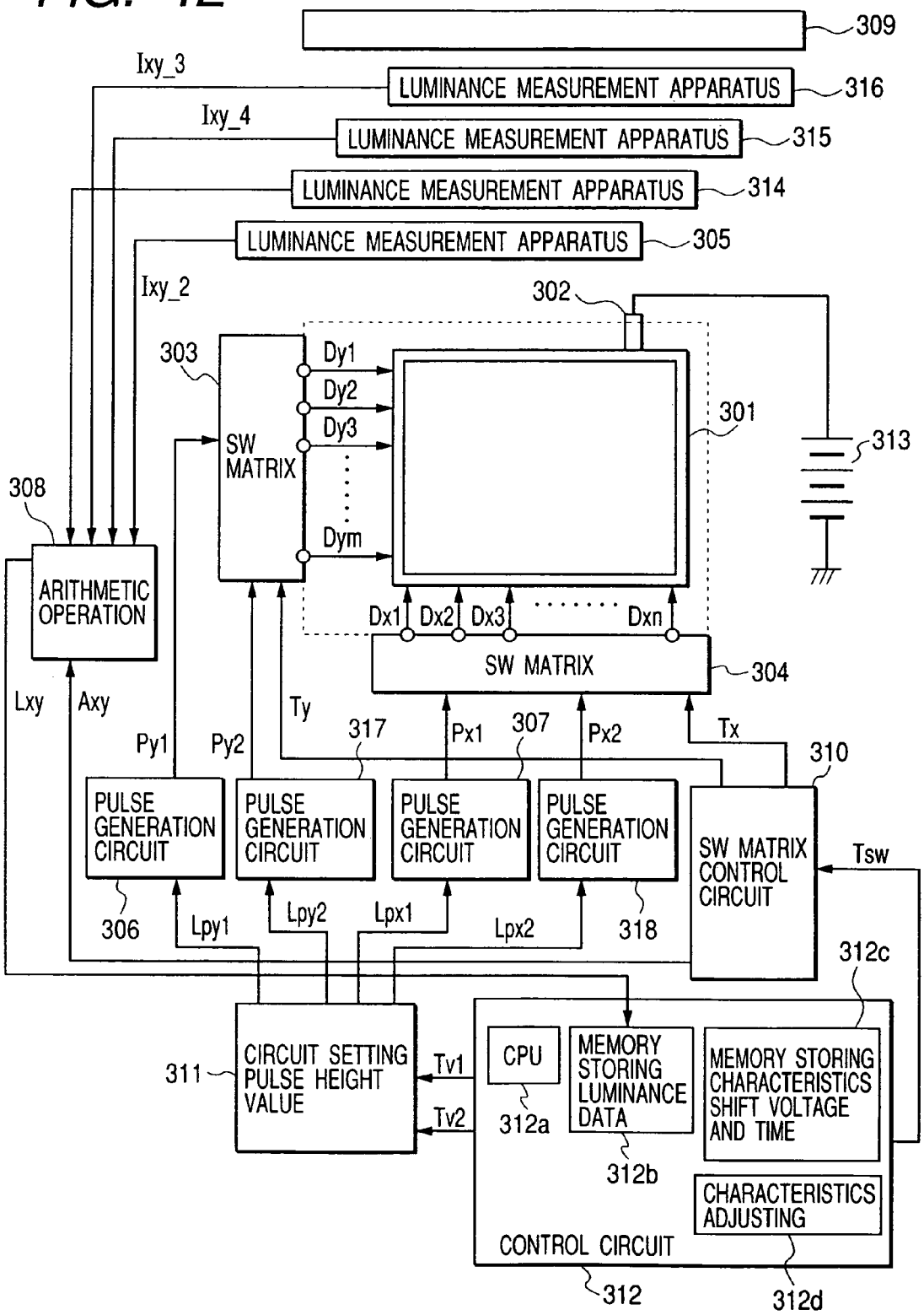
FIG. 12 is a schematic diagram showing an image forming apparatus using a multi-electron source and an characteristic adjustment apparatus for an image forming apparatus for applying a characteristic adjustment signal to this image forming apparatus, which are used in a second embodiment of the characteristic adjustment method for an image forming apparatus in accordance with the present invention.

FIG. 12 shows a structure of an apparatus for arranging an electron emitting characteristic of each surface conduction electron emission device of the display panel 301 along a certain target set value. Luminance measurement systems 314, 315 and 316 and pulse generation circuits 317 and 318 are added to the structure shown in FIG. 4. FIG. 12 is a schematic diagram of an image forming apparatus using a multi-electron source and a characteristic adjustment apparatus for an image forming apparatus for applying a characteristic adjustment signal to this image forming apparatus, which are used in the second embodiment of the characteristic adjustment method for an image forming apparatus in accordance with the present invention.

Since manufacturing of a display panel is common to the first and second embodiments, descriptions of the manufacturing will be omitted. In this embodiment, acceleration of processing is realized by providing four sights that are selected at a time.

Figure 13:
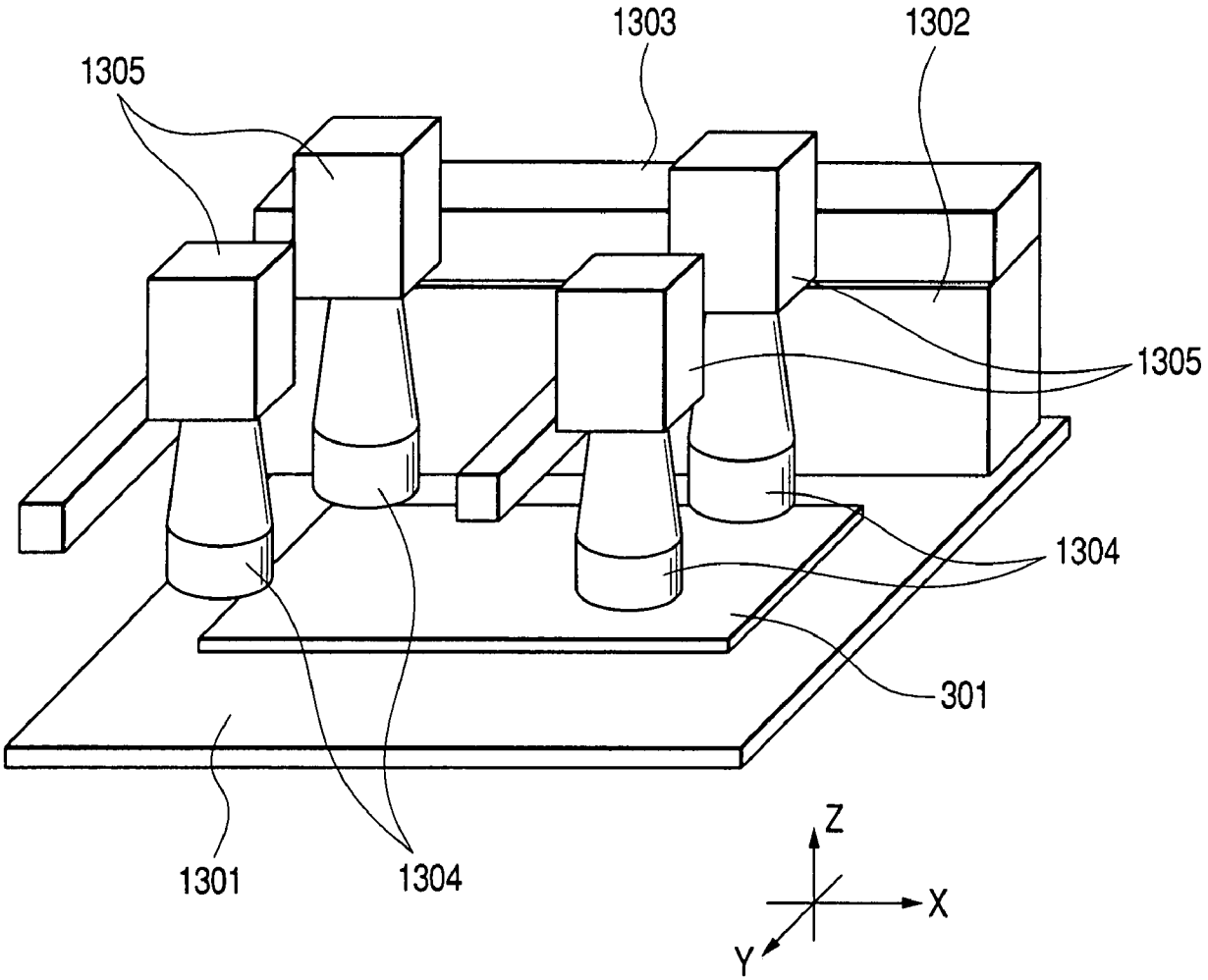
FIG. 13 is a perspective view showing a structure of the characteristic adjustment apparatus in the second embodiment of the characteristic adjustment method for an image forming apparatus in accordance with the present invention.

FIG. 13 is a perspective view showing a structure of the characteristic adjustment apparatus in the second embodiment of the characteristic adjustment method for an image forming apparatus in accordance with the present invention.

The display panel 301 is placed on a stage 1301 and a robot system 1303 for moving an optical system in X and Y directions is arranged on a pedestal 1302 as illustrated in the schematic view shown in FIG. 13. The optical system consists of a lens 1304 and a CCD camera 1305, and four optical systems are arranged.

Figure 14:
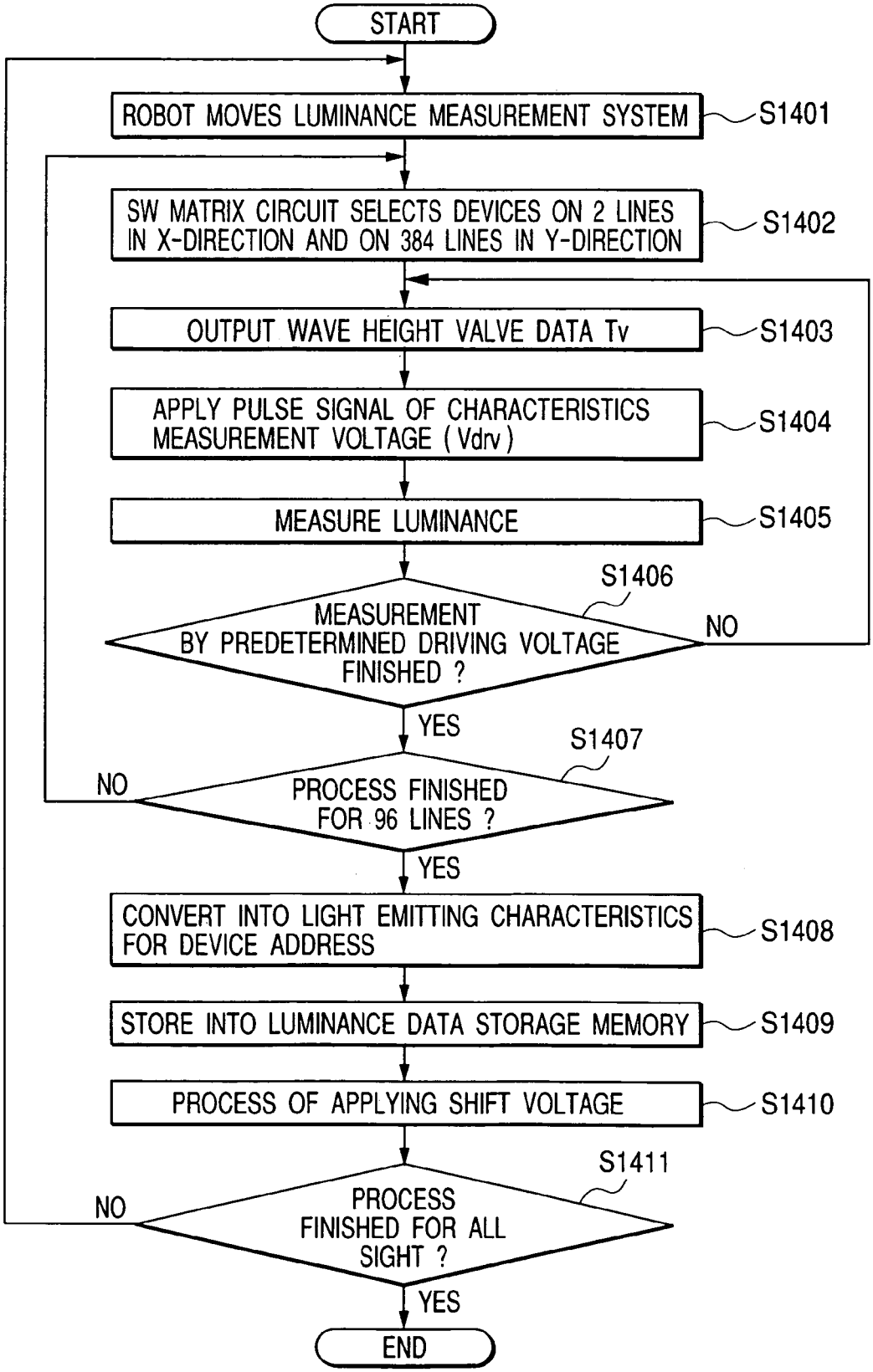
FIG. 14 is a flow chart showing processing for performing characteristic adjustment of each surface conduction electron emission device of an electron source of the second embodiment of the characteristic adjustment method for an image forming apparatus in accordance with the present invention.

Operation of the second embodiment of the characteristic adjustment method for an image forming apparatus in accordance with the present invention will be described with reference to FIG. 14. FIG. 14 is a flow chart showing processing for performing characteristic adjustment of each surface conduction electron emission device of an electron source of the second embodiment of the characteristic adjustment method for an image forming apparatus in accordance with the present invention.

Figure 15:
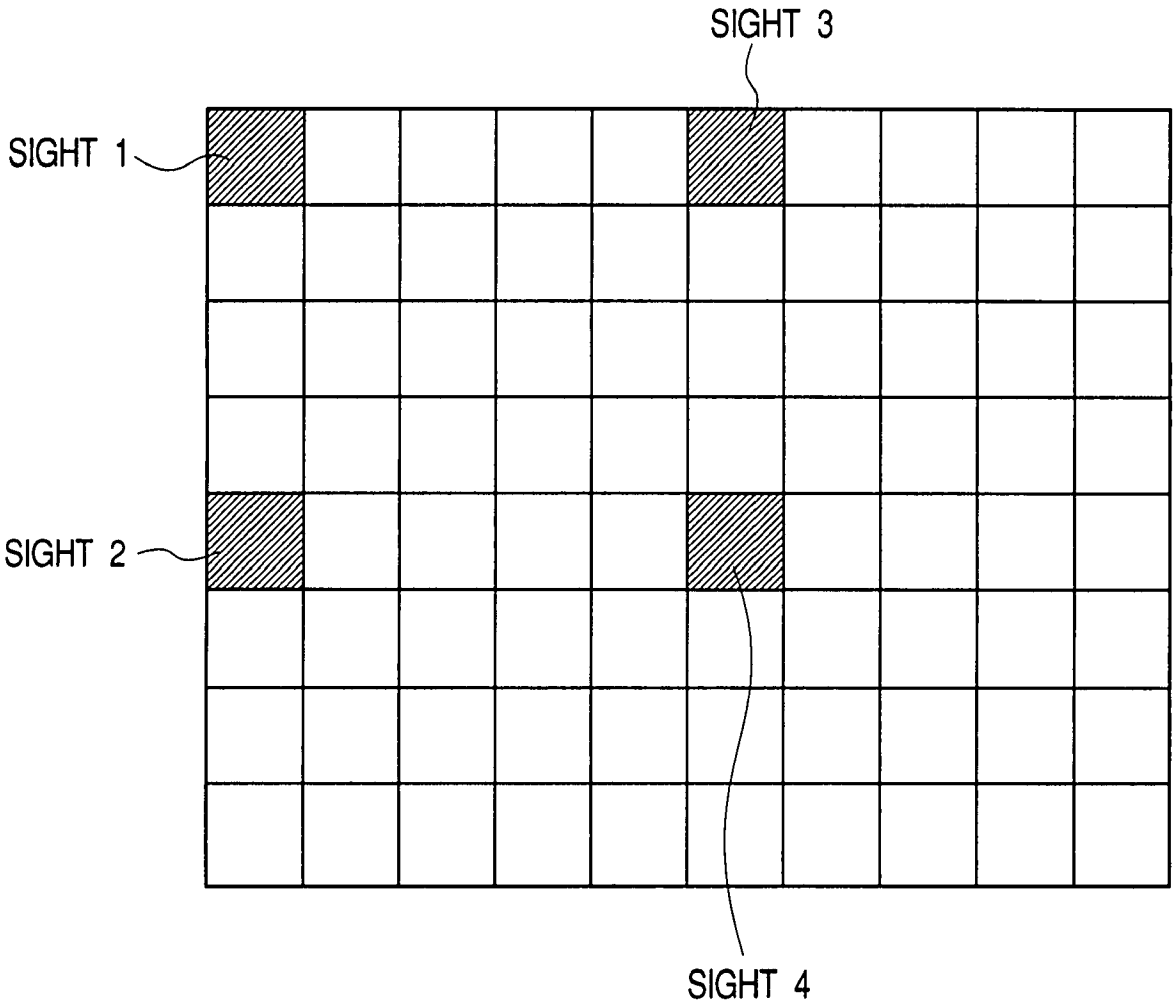
FIG. 15 is a schematic view showing sight positions set in the image forming apparatus in the second embodiment of the characteristic adjustment method for an image forming apparatus in accordance with the present invention.

First, in step 1401, two optical systems are moved to two places among a sight 1, a sight 2, a sight 3 and a sight 4 as shown in FIG. 15. FIG. 15 is a schematic view showing sight positions that are set in the image forming apparatus in the second embodiment of the characteristic adjustment method for an image forming apparatus in accordance with the present invention.

In step 1402, the switch matrix control signal Tsw is outputted, and switch matrices 303 and 304 are switched by the switch matrix control circuit 310 to select 768 surface conduction electron emission devices of the display panel 301.

Specifically, in an operation in the case in which one of a plurality of sights is selected, for example, devices are selected such that switches on Y=1, Y=385, X=1 to 384 and X=0.1921 to 2304 are turned ON.

Next, in step 1403, wave height value data Tv1 and Tv2 of a pulse signal applied to the selected devices are outputted to the circuit setting a pulse wave height value 311.

Then, in step 1404, a pulse signal for characteristics measurement of an electron-emitting device is applied to the surface conduction electron emission devices selected in step 1402 by the pulse generation circuits 306, 307, 317 and 318 via the switch matrices 303 and 304.

Therefore, the total 1536 devices on Y=1, Y=385, X=1 to 384 and X=1921 to 2304 are simultaneously driven.

Here, the total number of the devices is 1536 because X=1 to 384 and X=1921 to 2304 are lighted with respect to two lines of Y=1 and Y=385. This means that four parts are lighted two-dimensionally.

Next, in step 1405, luminance with respect to a drive voltage is measured. Then, in step 1406, it is judged whether or not measurement of a luminance value with respect to a predetermined drive voltage is finished.

In this embodiment, a drive voltage was changed to measure luminance for a plurality of times under three kinds of conditions, Vdrv, Vdrv−0.5 Volt and Vdrv−1 Volt.

If the luminance measurement by the predetermined drive voltage is not finished, the processing from step 1402 to step 1405 is repeated until the luminance measurement by the predetermined drive voltage is finished. If the luminance measurement by the predetermined drive voltage is finished, the processing moves to step 1407.

The processing from step 1403 to step 1406 is repeated 96 times while sequentially increasing the number of designated row wirings (Y) (step 1407).

Four rectangular areas of Y=1 to 96, Y=385 to 480, X=1 to 384 and X=1921 to 2304 are lighted by this operation.

The synchronizing signal Tsync in synchronous with the lighting of these rectangular areas is outputted from the control circuit 312, and the electronic shutter is opened based on the signal. Consequently, a light emitting image in the area driven in step 1405 is measured.

Here, a voltage to be applied to each area at this time will be described. A voltage is also applied to the places indicated by bold slanted line parts as duplicate areas in FIG. 15.

Characteristics of devices vary when a shift voltage is applied to devices other than a device to be adjusted. This problem was avoided in this embodiment in the following manner.

When it is assume that a voltage applied from a Y side of the sights 1 and 2 is Py1, a voltage applied from an X side of the sights 1 and 2 is Px1, a voltage applied from a Y side of the sights 3 and 4 is Py2, and voltage applied form an X side of the sights 3 and 4 is Px2, a voltage of Py1+Px1 is applied to devices in the sight 1. A voltage of Py2+Px1 is applied to devices in the sight 2.

A voltage of Py1+Px2 is applied to devices in the sight 3. A voltage of Py2+Px2 is applied to devices in the sight 2.

Therefore, instruction signals Lp1, Lp2, Lp3 and Lp4 were determined such that the four types of voltages became the Vdrv voltages in measuring luminance.

Next, in step 1408, the measured luminance is converted into luminance values corresponding to device addresses based on a light emitting image and addresses of driven devices. In this way, luminance values for four parts where 384×96 devices are arranged could be obtained.

Then, luminance data is stored in a luminance data storage memory (step 1409) and processing of applying a shift voltage is performed (step 1410). Then, it is checked if the luminance measurement and the processing of applying a shift voltage are finished for all the sights (step 1411) and, if finished, the operations are finished.

Figure 16:
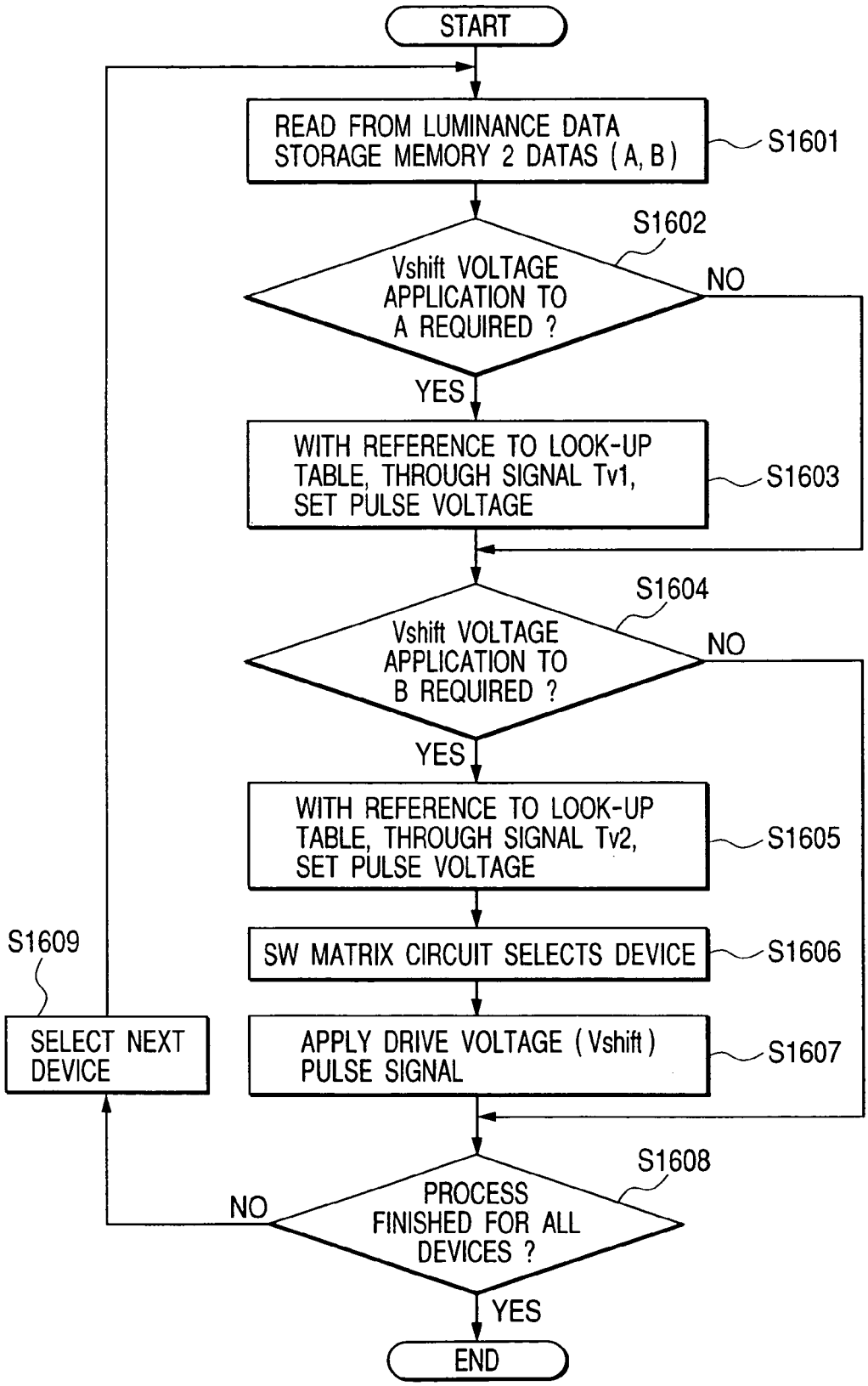
FIG. 16 is a flow chart showing processing for applying a characteristic adjustment signal in the second embodiment of the characteristic adjustment method for an image forming apparatus in accordance with the present invention.
Figure 17:
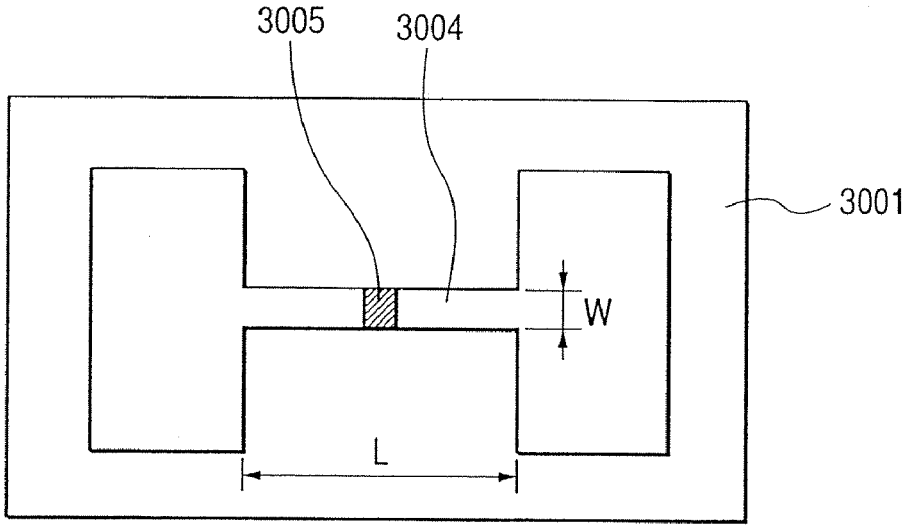
PRIOR ART FIG. 17
FIG. 17 is a view showing a structure of a conventional surface conduction electron emission device.
Figure 18:
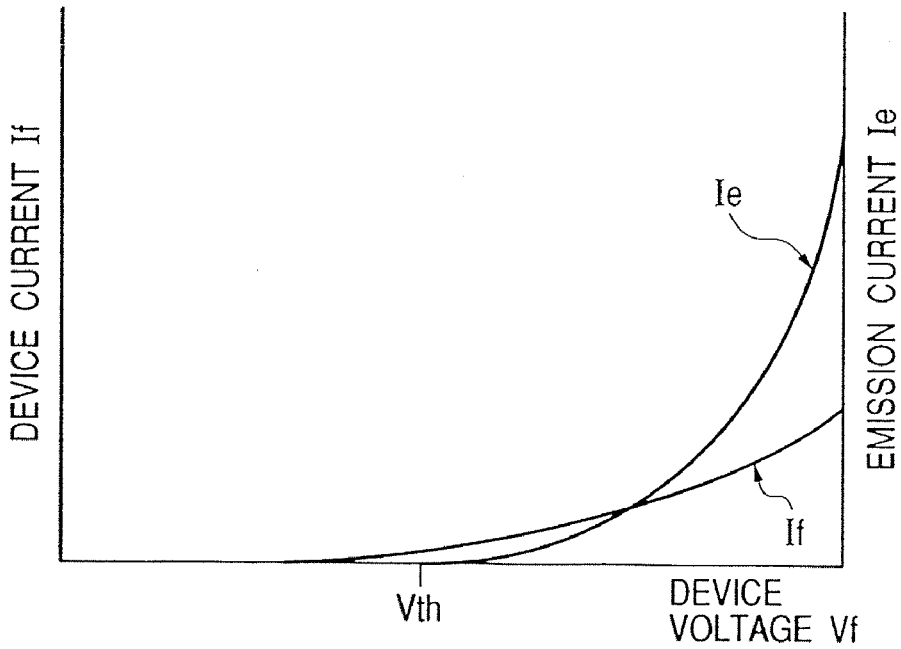
PRIOR ART FIG. 18
FIG. 18 is a graph showing an example of a device characteristic of a surface conduction electron emission device.
Figure 19:
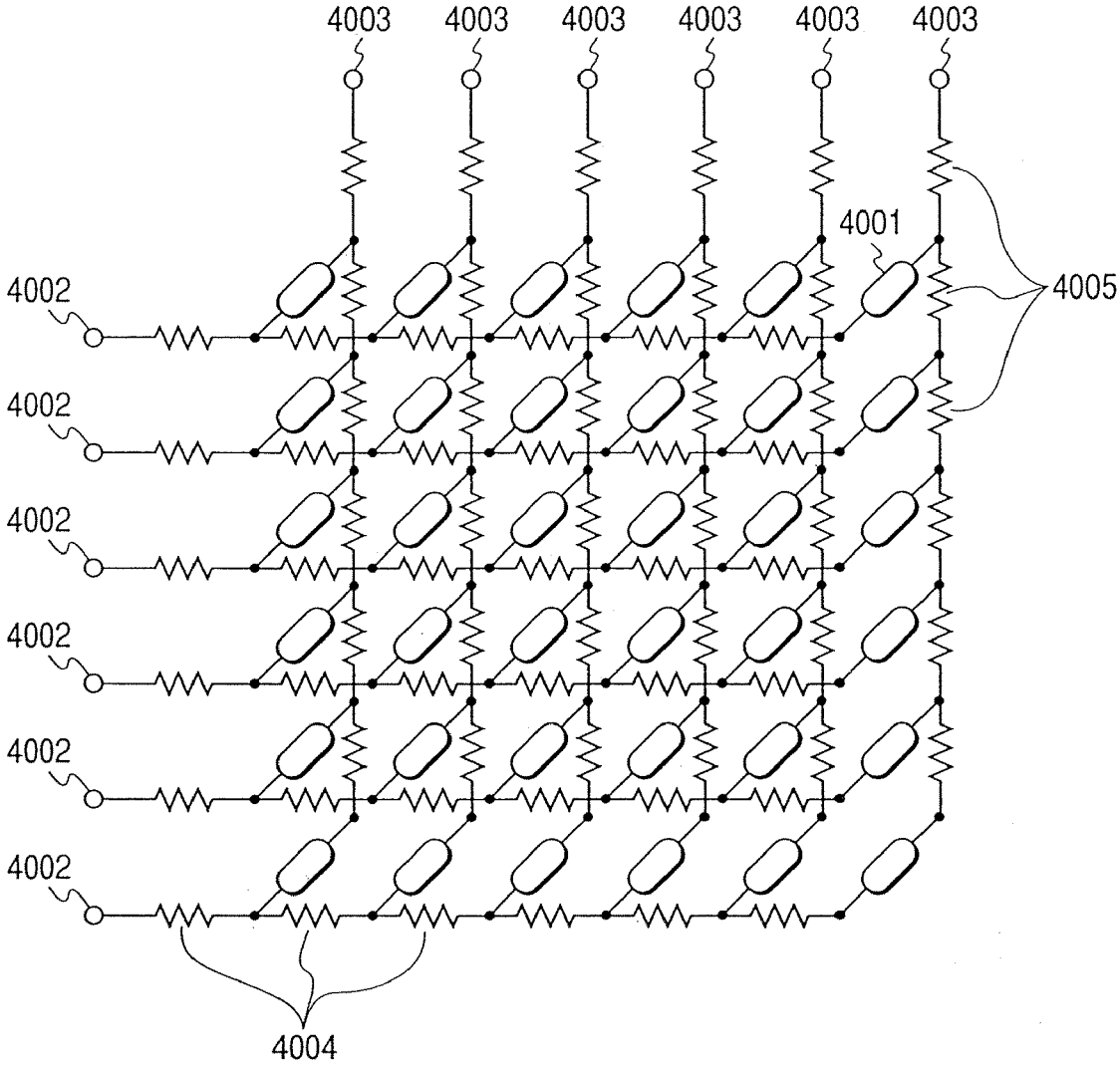
PRIOR ART FIG. 19
FIG. 19 is a view explaining matrix wiring of a conventional multi-electron source.
Figure 20:
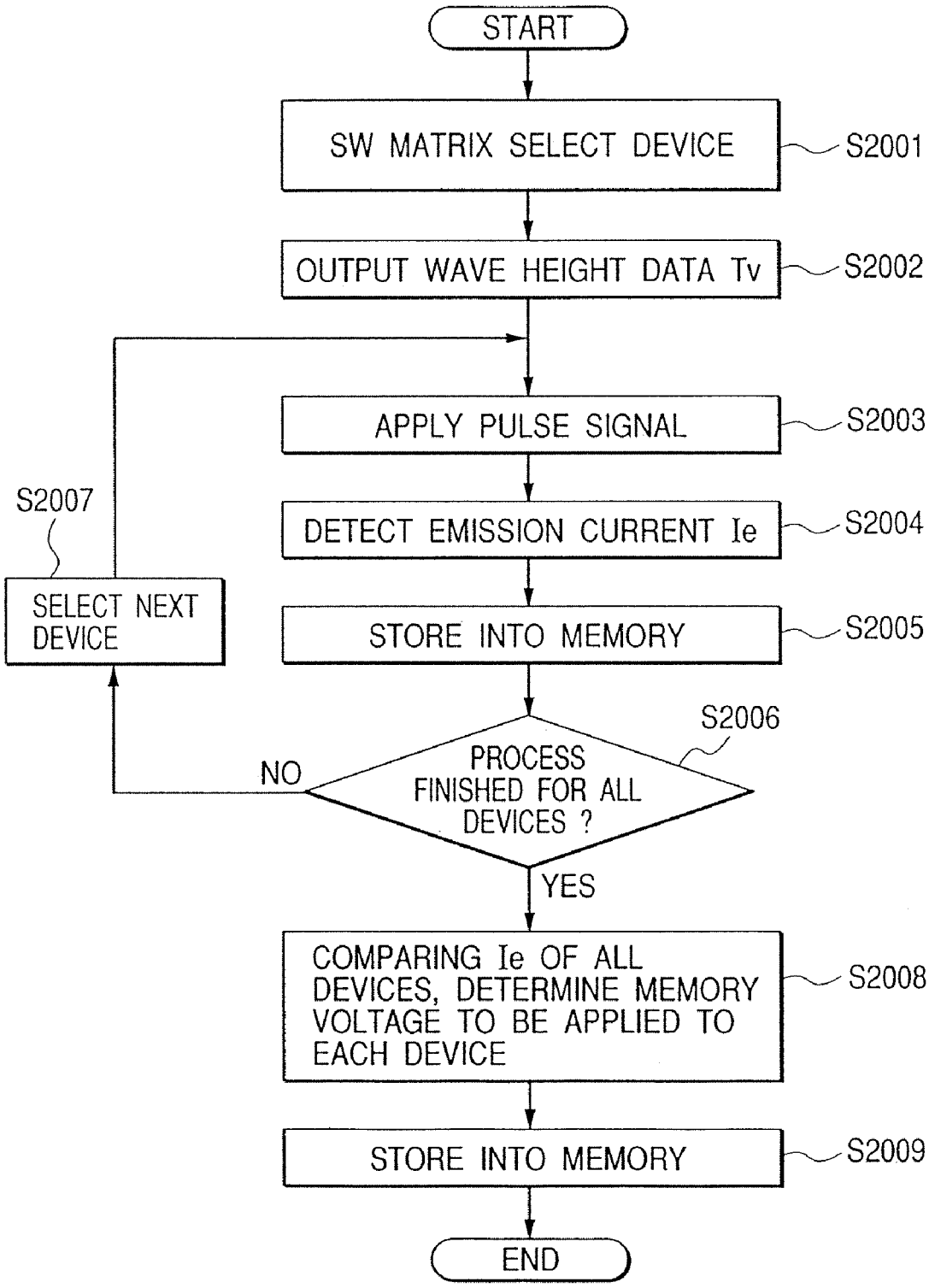
PRIOR ART FIG. 20
FIG. 20 is a flow chart of a characteristic measurement process in a characteristic adjustment method of a conventional invention.

Processing for shifting a characteristic will be described with reference to FIG. 16. FIG. 16 is a flow chart showing processing for applying a characteristic adjustment signal in the second embodiment of the characteristic adjustment method for an image forming apparatus in accordance with the present invention. In this embodiment, one device for two sights, respectively, total two devices are selected, and a shift voltage is applied to the devices simultaneously.

The shift voltage is not applied to one device for four sights, respectively, total four devices, due to the following reasons.

For example, in FIG. 15, if shift voltages that are required to be applied to devices in the sight 1, the sight 2, the sight 3 and the sight 4 are 16, 15, 15.5 and 16 Volts, respectively, since only voltages of the above-mentioned combination are applied to the sights, Py1, Py2, Px1 and Px2 cannot be determined.

In addition, even if it is attempted to select two devices to which shift voltages are applied simultaneously out of the sight 1 and the sight 4, since a voltage is also applied to the parts of the sight 2 and the sight 3, the different shift voltages cannot be applied simultaneously.

Thus, as shown in FIG. 16, in step 1601, luminance data of devices of addresses corresponding to the respective sights 1 and 3 is read. For convenience, if the devices are assumed to be A and B, first, the luminance data for A is compared with a target value and presence or absence of application of a V shift voltage is judged.

It is judged whether or not application of a shift voltage is required (step 1602). If the application is required, in step 1603, a shift voltage Tv1 is determined with reference to a lookup table.

Next, in step 1604, presence or absence of shift voltage application to the device B is judged and, in step 1605, Tv2 is determined.

Next, a wave height value of a pulse is determined using the circuit setting a pulse wave height value 311 of FIG. 12. For example, if voltage application of 16 Volts and 15.5 Volts was required as Vpre for the device A and the device B, respectively, voltages were set as Py1=8 Volts, Py2=0 Volt, Px1=8 Volts and Px2=7.5 Volts.

In this case, since only a voltage equal to or lower than Vdrv was applied to the devices of the sight 2 and the sight 4, even if shift voltage application to the device A and the device B was performed simultaneously, characteristics were not affected.

In this way, the instruction signals Lp1, Lp2, Lp3 and Lp4 are determined. Then, devices to be selected are selected from the sight 2 and the sight 4 to perform the processing of applying a shift voltage sequentially.

In this embodiment, adjustment was performed using Vdrv=14 v, Vpre=16 v and Vshift=16 to 18 v, a short pulse with a pulse width of 1 ms and a period of 2 ms for the characteristic shift and a short pulse with a pulse width of 18 μs and a period of 20 μs for the luminance measurement. Thus, devices are selected in step 1606 using the above-mentioned voltage setting and, in step 1607, a shift voltage is actually applied.

The above processing is applied to all the devices within the two sights (step 1609) and, it is judged in step 1608 that the luminance measurement and the processing of applying a shift voltage are finished for all the sights, the operations are finished.

Time required for measuring luminance values of the entire screen was approximately 80 second that was one fourth of that in the first embodiment. In this embodiment, since it has become possible to apply a shift voltage to two devices simultaneously, application time of the shift voltage could be reduced to 3,000 seconds that was one half of that in the first embodiment.

When the image forming apparatus manufactured by the above process was driven at Vdrv=14 Volt to measure luminance fluctuation of the entire surface, a standard deviation/average value was 3%, and the image forming apparatus equivalent to the image forming apparatus manufactured in the first embodiment was manufactured.

Although the embodiment in the case in which sights are increased to two is described, if the number of optical systems is increased, time required for luminance measurement can be reduced so much more for that.

In addition, in this embodiment, since four signal and pulse generation circuits for setting a pulse wave height value were provided, four sights were set and a shift voltage was applied to two devices simultaneously. However, if the number of the pulse generation circuits is increased, it is possible to further increase the number of devices to which the shift voltage can be applied simultaneously.

As described above, according to the present invention, in the case in which the present invention is applied to a large screen TV, a display panel is divided into a plurality of sights to obtain a light emitting characteristic and to sequentially perform adjustment processing, whereby luminance fluctuation of a display apparatus due to irregular fluctuation of an electron-emitting characteristic of each electron-emitting device can be reduced.

Moreover, since light emitting characteristics of a plurality of devices can be obtained simultaneously, adjustment processing can be performed at a high speed. Thus, a process time required for characteristic adjustment can be reduced significantly.

What is claimed is:

1. A characteristic adjustment apparatus for an image forming apparatus that is provided with a multi-electron source in which a plurality of electron-emitting devices are electrically connected by wiring and arranged on a substrate and a fluorescent member for emitting light by irradiation of an electron beam, comprising:

at least one or more luminance measurement apparatus that is capable of, in the case where a display portion of said image forming apparatus is divided into a plurality of areas, measuring luminance of electron-emitting devices of the entire one area among the plurality of areas without moving;

a control circuit for calculating a characteristic shift voltage to be applied to said electron-emitting devices based on a relationship between a drive voltage applied to said electron-emitting devices and luminance measured by said luminance measurement apparatus, the characteristic shift voltage being larger than a voltage applied to said electron-emitting devices for forming an image; and applying means for applying said characteristic shift voltage to said electron-emitting devices so as to shift an emission current characteristics of said electron-emitting devices.

2. A characteristic adjustment apparatus according to claim 1, wherein said luminance measurement apparatus measures luminance of a plurality of electron-emitting devices, which are simultaneously driven, in said divided areas.

3. A characteristic adjustment apparatus according to claim 1, wherein said control circuit is provided with a memory for storing a relationship between luminance and a drive voltage of at least one or more electron-emitting devices with different initial characteristics and storing, for each of said electron-emitting devices with different initial characteristics, a relationship between a characteristic shift voltage to be applied to said electron-emitting device and an emission current from said electron-emitting device, selects a relationship between the luminance and the drive voltage stored in said memory with which a relationship between the luminance and the drive voltage of said electron-emitting devices whose luminance is measured substantially coincides, and calculates a characteristic shift voltage to be applied to said measured electron-emitting devices based on a relationship between said characteristic shift voltage of an electron-emitting device, which has the selected relationship between the luminance and the drive voltage, and an emission current from said electron-emitting device.

* * * * *

UNITED STATES PATENT AND TRADEMARK OFFICE

CERTIFICATE OF CORRECTION

PATENT NO. : 7,388,561 B2
APPLICATION NO. : 11/049996
DATED : June 17, 2008
INVENTOR(S) : Akihiko Yamano et al.

It is certified that error appears in the above-identified patent and that said Letters Patent is hereby corrected as shown below:

COLUMN 1:

Line 44, “spattering.” should read --sputtering.--.

COLUMN 2:

Line 9, “them-is” should read --them is--; and
Line 67, “voltage-Vth)” should read --voltage Vth)--.

COLUMN 3:

Line 61, “information:” should read --information--.

COLUMN 5:

Line 46, “form” should read --from--.

COLUMN 6:

Line 62, “an” should read --a--.

COLUMN 8:

Line 7, “mage” should read --image--;
Line 24, “forming” should read --forming apparatus--;
Line 37, “in that:” should read --by including:--; and
Line 63, “form” should read --from--.

COLUMN 10:

Line 20, “means-for” should read --means for--.

COLUMN 12:

Line 32, “were formed” should be deleted; and
Line 48, “conductor” should read --conductors--.

UNITED STATES PATENT AND TRADEMARK OFFICE

CERTIFICATE OF CORRECTION

PATENT NO. : 7,388,561 B2
APPLICATION NO. : 11/049996
DATED : June 17, 2008
INVENTOR(S) : Akihiko Yamano et al.

It is certified that error appears in the above-identified patent and that said Letters Patent is hereby corrected as shown below:

COLUMN 13:

Line 63, “measuring” should read --measures--.

COLUMN 15:

Line 34, “apparatus” should read --circuit--; and
Line 37, “has” should read --have--.

COLUMN 16:

Line 34, “apparatus” should read --circuit--.

COLUMN 17:

Line 11, “kin” should read --in--; and
Line 63, “Current” should read --current--.

COLUMN 18:

Line 25, “applied,” should read --applied--; and
Line 50, “signal.” should read --signal--.

COLUMN 19:

Line 35, “80 mmx60 μm” should read --80 mmx60 mm--; and
Line 39, “0.18 V,” should read --18 V,--.

COLUMN 20:

Line 7, “is.” should read --is--;
Line 8, “changes” should read --changes in--; and
Line 18, “B, phosphors).” should read --B phosphors).--.

COLUMN 21:

Line 46, “X=0.1921” should read --X=1921--; and
Line 62, “measured. Then,” should read --measured. ¶ Then,--.

UNITED STATES PATENT AND TRADEMARK OFFICE

CERTIFICATE OF CORRECTION

PATENT NO. : 7,388,561 B2
APPLICATION NO. : 11/049996
DATED : June 17, 2008
INVENTOR(S) : Akihiko Yamano et al.

It is certified that error appears in the above-identified patent and that said Letters Patent is hereby corrected as shown below:

COLUMN 22:

Line 24, “assume” should read --assumed--;
Line 27, “form” should read --from--; and
Line 32, “sight 2.” should read --sight 4.--.

COLUMN 23:

Line 45, “second that” should read --seconds which--;
Line 49, “that” (first occurrence) should read --which--; and
Line 52, “volt” should read --Volts--.

COLUMN 24:

Line 37, “an” should be deleted.

Signed and Sealed this

Twenty-fifth Day of November, 2008

JON W. DUDAS
*Director of the United States Patent and Trademark Office*